US010978041B2

(12) United States Patent
Wang

(10) Patent No.: US 10,978,041 B2
(45) Date of Patent: Apr. 13, 2021

(54) AMBIENT SOUND PROCESSING METHOD AND DEVICE

(71) Applicant: HUAWEI TECHNOLOGIES CO., LTD., Guangdong (CN)

(72) Inventor: Liang Wang, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 371 days.

(21) Appl. No.: 16/062,764

(22) PCT Filed: Dec. 17, 2015

(86) PCT No.: PCT/CN2015/097706
§ 371 (c)(1),
(2) Date: Jun. 15, 2018

(87) PCT Pub. No.: WO2017/101067
PCT Pub. Date: Jun. 22, 2017

(65) Prior Publication Data
US 2020/0296500 A1 Sep. 17, 2020

(51) Int. Cl.
*G10K 11/178* (2006.01)
*H04R 1/10* (2006.01)

(52) U.S. Cl.
CPC .. *G10K 11/17881* (2018.01); *G10K 11/17823* (2018.01); *G10K 11/17837* (2018.01);
(Continued)

(58) Field of Classification Search
CPC ..... H04R 1/1083; H04R 2460/01; G10K 11/17823; G10K 11/17827;
(Continued)

(56) References Cited

U.S. PATENT DOCUMENTS 6,118,878 A * 9/2000 Jones ..... G10K 11/17855 381/72
7,065,219 B1 6/2006 Abe et al.
(Continued)

FOREIGN PATENT DOCUMENTS

CN 2355405 Y 12/1999
CN 101115318 A 1/2008
(Continued)

OTHER PUBLICATIONS

International Search Report issued in International Application No. PCT/CN2015/097706 dated Sep. 14, 2016, 14 pages.

*Primary Examiner* — Jason R Kurr
(74) *Attorney, Agent, or Firm* — Fish & Richardson P.C.

(57) ABSTRACT

An ambient sound processing method provided includes determining a time-frequency spectrum of an ambient sound in preset duration. A matching scenario is determined from at least one preset scenario according to the time-frequency spectrum of the ambient sound in the preset duration, where a time-frequency spectrum of the matching scenario matches the time-frequency spectrum of the ambient sound in the preset duration. Operation information corresponding to the matching scenario is determined as the operation information to be executed, and an operation is performed according to the operation information to be executed and a subsequently received ambient sound, and an operated signal is determined. The operated signal is mixed to obtain a mixed signal, and the mixed signal is transmitted to a headset, where the mixed signal includes at least an audio signal played by user equipment of a user.

18 Claims, 5 Drawing Sheets

(52) U.S. Cl.
CPC .. *G10K 11/17853* (2018.01); *G10K 11/17855* (2018.01); *G10K 11/17885* (2018.01); *H04R 1/1083* (2013.01); *H04R 2460/01* (2013.01)

(58) Field of Classification Search
CPC ..... G10K 11/17853; G10K 2210/1081; G10K 11/17881; G10K 11/17837; G10K 11/17885
See application file for complete search history.

(56) References Cited

U.S. PATENT DOCUMENTS

| | | | | |
|---|---|---|---|---|
| 10,032,464 | B2 * | 7/2018 | Franklin | G10L 25/51 |
| 2003/0235313 | A1 | 12/2003 | Kurzweil et al. | |
| 2004/0081323 | A1 | 4/2004 | Sung | |
| 2008/0137873 | A1 * | 6/2008 | Goldstein | H04R 1/1083 381/57 |
| 2008/0181419 | A1 * | 7/2008 | Goldstein | G10K 11/17827 381/57 |
| 2010/0011024 | A1 | 1/2010 | Suzuki et al. | |
| 2014/0044269 | A1 | 2/2014 | Anderson | |
| 2017/0200442 | A1 * | 7/2017 | Yamabe | G10K 11/17827 |

FOREIGN PATENT DOCUMENTS

| | | | |
|---|---|---|---|
| CN | 101369422 | A | 2/2009 |
| CN | 201311777 | Y | 9/2009 |
| CN | 101625863 | A | 1/2010 |
| CN | 102695112 | A | 9/2012 |
| CN | 103581803 | A | 2/2014 |
| CN | 104581519 | A | 4/2015 |
| CN | 104618829 | A | 5/2015 |
| CN | 104602155 | B | 3/2019 |

* cited by examiner

AMBIENT SOUND PROCESSING METHOD AND DEVICE

CROSS-REFERENCE TO RELATED APPLICATIONS

This application is a National Stage of International Application No. PCT/CN2015/097706, filed on Dec. 17, 2015, which is hereby incorporated by reference in its entirety.

TECHNICAL FIELD

The present invention relates to the field of signal technologies, and in particular, to an ambient sound processing method and device.

BACKGROUND

An active noise reduction (Ambient Noise Cancellation, ANC for short) technology is a technology for canceling low and medium frequency noises in an ambient environment, so as to deliver quiet listening experience when a user listens to audio. By canceling noises in the ambient environment, volume may be lowered to protect hearing of a user while ensuring that the user can clearly listen.

Low and medium frequency noises in life mainly come from vehicles, fans, motors, or the like. Therefore, an active noise reduction function is mainly used in the vehicles (such as an airplane, an automobile, a bus, a subway, and a train), or may be used in places such as an office and a factory building.

In the prior art, a noise reduction headset produced by using the active noise reduction technology can effectively cancel the noises in ambient sounds, so that the user can listen to music at ease. However, the noise reduction headset in the prior art cancels all ambient sounds, even sounds such as an automobile horn and an alarm that are used for reminding the user. This is dangerous for the user.

Based on the foregoing description, it can be learned that the user may use the noise reduction headset in various scenarios, but different scenarios may have different requirements. For example, the user needs to hear a sound of an automobile horn, which is used for reminding the user. However, the noise reduction headset in the prior art just performs noise reduction on all ambient sounds, and cannot provide diversified services according to a scenario in which the user stays.

In conclusion, an ambient sound processing method is urgently needed to perform a more accurate operation on an ambient sound based on a scenario in which the user stays, so as to provide a more accurate prompt and a better service for the user.

SUMMARY

Embodiments of the present invention provide an ambient sound processing method, so as to perform a more accurate operation on an ambient sound based on a scenario in which a user stays, and provide a more accurate prompt and a better service for the user.

An embodiment of the present invention provides an ambient sound processing method, including:

determining a time-frequency spectrum of an ambient sound in preset duration according to the received ambient sound in the preset duration;

determining a matching scenario from a time-frequency spectrum of at least one preset scenario according to the time-frequency spectrum of the ambient sound in the preset duration, where a time-frequency spectrum of the matching scenario matches the time-frequency spectrum of the ambient sound in the preset duration;

determining operation information corresponding to the matching scenario as operation information to be executed;

performing an operation according to the operation information to be executed and a subsequently received ambient sound, and determining an operated signal; and mixing the operated signal with an audio signal played by user equipment, to obtain a mixed signal, and transmitting the mixed signal to a headset.

Because some sporadic sounds may exist, it is inaccurate to analyze a scenario in which a user stays only according to a sound included in the ambient sound. Based on this, in this embodiment of the present invention, analysis is performed according to the time-frequency spectrum of the ambient sound in the preset duration, so that accuracy of recognition of the ambient sound is further improved. Then, when the matching scenario is determined from the at least one preset scenario according to the time-frequency spectrum of the ambient sound in the preset duration, a matching scenario that is closest to a real scenario in which the user stays can be determined. Then, when the operation is performed according to the operation information corresponding to the matching scenario, that is, the operation is performed according to the real scenario in which the user stays, so that a more accurate operation is performed on the ambient sound according to the scenario in which the user stays, and a more accurate prompt and a better service are provided for the user.

Optionally, the determining a matching scenario from a time-frequency spectrum of at least one preset scenario according to the time-frequency spectrum of the ambient sound in the preset duration specifically includes:

performing normalized cross correlation on the time-frequency spectrum of the ambient sound in the preset duration and a time-frequency spectrum of each scenario in the at least one preset scenario, to obtain at least one cross correlation value;

if a largest cross correlation value in the at least one cross correlation value is greater than a cross correlation threshold, determining a scenario corresponding to the largest cross correlation value as an alternative scenario, where at least one characteristic spectrum is preset for the alternative scenario, and the characteristic spectrum of the alternative scenario includes all or a part of a time-frequency spectrum of the alternative scenario;

determining energy of each characteristic spectrum in the at least one characteristic spectrum from the time-frequency spectrum of the ambient sound in the preset duration;

determining average energy of all characteristic spectrums of the ambient sound in the preset duration according to energy of each characteristic spectrum of the ambient sound in the preset duration; and when it is determined that the average energy is greater than an energy threshold, determining the alternative scenario as the matching scenario.

Specifically, when a cross correlation value between a time-frequency spectrum of the alternative scenario and the time-frequency spectrum of the ambient sound received by a processing device is greater than a cross correlation threshold, and the preset alternative scenario is corresponding to N core frequencies, the time-frequency spectrum of the ambient sound also definitely includes the N core frequencies corresponding to the alternative scenario. Further, because the characteristic spectrum corresponding to the alternative scenario includes all or some of the N core frequencies corresponding to the alternative scenario, the time-frequency spectrum of the ambient sound also definitely includes the characteristic spectrum corresponding to the alternative scenario. Therefore, when the alternative scenario is determined, energy of each characteristic spectrum in the at least one characteristic spectrum may be determined from the time-frequency spectrum of the ambient sound in the preset duration according to the at least one preset characteristic spectrum corresponding to the alternative scenario.

In this way, accuracy of recognition of the ambient sound may be improved, that is, the determined matching scenario is closer to a real ambient environment; and then, when the operation is performed according to the operation information corresponding to the matching scenario, the operation can be more accurate, and a more accurate service can be provided for the user.

Optionally, the operation information to be executed includes performing signal enhancement processing on the ambient sound; and the performing an operation according to the operation information to be executed and a subsequently received ambient sound, and obtaining an operated signal specifically includes:

determining, according to the subsequently received ambient sound, a prompt sound used for reminding a user to notice the subsequently received ambient sound, and using the prompt sound as the operated signal; and if a power value of an ambient sound that is on a preset frequency band and that is included in the subsequently received ambient sound is greater than a power threshold, generating, according to the subsequently received ambient sound, a phase-inverted sound wave used for noise reduction on the subsequently received ambient sound, and using the phase-inverted sound wave as the operated signal, where the preset frequency band is a preset frequency range of at least one noise.

In this way, after determining the scenario that matches the ambient sound, a prompt sound is determined from a preset database that is used for storing the prompt sound, the prompt sound is mixed with an audio signal, the mixed signal is transmitted to human ears, and in this case, a person may hear the prompt sound and then stay alert. Therefore, a problem that the user is insensitive to a key sound in the ambient sound after wearing the headset is alleviated. In addition, noise reduction is further performed on the ambient sound by using the generated phase-inverted sound wave. In this case, the prompt sound output by the processing device can be highlighted, that is, because noise reduction is performed on the ambient sound, the prompt sound heard by the user is clearer, so that the user stays more alert. In a third aspect, in this case, the user may further hear the audio signal. It can be learned that, in this embodiment of the present invention, the user can still enjoy the audio signal when the prompt sound is sent to the user to make the user stay alert. Therefore, in this embodiment of the present invention, a more comfortable audio environment is provided for the user.

Optionally, the operation information to be executed includes any one or any combination of the following items:

performing signal enhancement processing on the ambient sound, prompting a direction of the ambient sound, performing speech recognition processing on the ambient sound, or performing noise reduction processing on the ambient sound.

Optionally, the operation information to be executed includes performing signal enhancement processing on the ambient sound; and the performing an operation according to the operation information to be executed and a subsequently received ambient sound, and obtaining an operated signal specifically includes:

performing filtering on the subsequently received ambient sound by using a filter, to obtain a filtered ambient sound, and using the filtered ambient sound as the operated signal.

In this way, filtering is performed on the subsequently received ambient sound by using the filter, to obtain the filtered ambient sound, so as to retain a part that is of the ambient sound and that the user expects to hear. Then, the filtered signal is transmitted to human ears, and is superposed on a sound that can be heard by the ears of the user, so that the part that is of the ambient sound and that the user expects to hear is highlighted, that is, sounds such as a sound of the wind, twittering, and chirping that are heard by the user are enhanced. In this way, when enjoying music, the user also hears a beautiful sound in the ambient sound.

Optionally, after the performing an operation according to the operation information to be executed and a subsequently received ambient sound, and obtaining an operated signal, the method further includes:

if a power value of an ambient sound that is on a preset frequency band and that is included in the subsequently received ambient sound is greater than a power threshold, generating, according to the subsequently received ambient sound, a phase-inverted sound wave used for noise reduction on the subsequently received ambient sound, and using the phase-inverted sound wave as the operated signal, where the preset frequency band is a preset frequency range of at least one noise.

In this way, on one hand, the filtered signal is transmitted to the human ears, and is superposed on the sound that can be heard by the ears of the user, so that the part that is of the ambient sound and that the user expects to hear is highlighted. On the other hand, because noise reduction is performed on the ambient sound, volume of the ambient sound that can be heard by the user is lower. In this case, the filtered ambient sound output by the processing device is highlighted, that is, the filtered ambient sound heard by the user in this case is clearer, so that user experience is improved, and the user may further hear an audio signal in this case. It can be learned that, in this embodiment of the present invention, the user can still enjoy the audio signal when the filtered ambient sound is sent to the user. Therefore, in this embodiment of the present invention, a more comfortable audio environment is provided for the user.

Optionally, before the performing filtering on the subsequently received ambient sound by using a filter, to obtain a filtered ambient sound, the method further includes:

performing compensation on the preset frequency response of the filter according to a preset frequency response of the filter, and a frequency response of the phase-inverted sound wave used for noise reduction on the subsequently received ambient sound, to obtain a compensated frequency response; and performing, by using the filter, filtering on the ambient sound that is on the preset frequency band and that is of the ambient sound by using the compensated frequency response, to obtain the filtered ambient sound.

In this way, on one hand, the filtered signal is transmitted to the human ears, and is superposed on the sound that can be heard by the ears of the user, so that the part that is of the ambient sound and that the user expects to hear is highlighted. On the other hand, because noise reduction is performed on the ambient sound, volume of the ambient sound that can be heard by the user is lower, and in this case, the filtered ambient sound output by the processing device is highlighted. Further, compensation is performed on the preset frequency response of the filter according to the preset frequency response of the filter, and the frequency response of the phase-inverted sound wave used for noise reduction on the subsequently received ambient sound. In this way, impact of the phase-inverted sound wave on the filtered ambient sound can be effectively reduced. On one hand, noise reduction is effectively performed on a noise in the ambient sound; and on the other hand, the sound that the user expects to hear in the ambient sound is enhanced. It can be learned that, in this embodiment of the present invention, the user can still enjoy the audio signal when the filtered ambient sound is sent to the user. Therefore, in this embodiment of the present invention, a more comfortable audio environment is provided for the user.

Optionally, the operation information to be executed includes prompting a direction of the ambient sound; and the performing an operation according to the operation information to be executed and a subsequently received ambient sound, and obtaining an operated signal specifically includes:

determining a phase difference and an amplitude difference between the subsequently received ambient sound that is received by a left sound pickup microphone of the headset and the subsequently received ambient sound that is received by a right sound pickup microphone of the headset; and determining, according to the determined phase difference and amplitude difference, a left alarm prompt sound that needs to be output to an audio-left channel of the headset, and a right alarm prompt sound that needs to be output to an audio-right channel of the headset; and using the left alarm prompt sound and the right alarm prompt sound as the operated signal, where a phase difference between the left alarm prompt sound and the right alarm prompt sound is the same as the determined phase difference between the subsequently received ambient sound that is received by the left sound pickup microphone and the subsequently received ambient sound that is received by the right sound pickup microphone of the headset; and an amplitude difference between the left alarm prompt sound and the right alarm prompt sound is the same as the determined amplitude difference between the subsequently received ambient sound that is received by the left sound pickup microphone and the subsequently received ambient sound that is received by the right sound pickup microphone of the headset.

Because the headset is worn on the head, positions of earbuds of the headset are quite close to positions of the human ears. In this case, a sound source may be analyzed by using the ambient sound received by both a right earbud and a left earbud, and then, the phase difference and the amplitude difference between the left alarm prompt sound and the right alarm prompt sound that are input to the human ears is the same as the phase difference and the amplitude difference between the real ambient sound that enters a left ear and the real ambient sound that enters a right ear. Therefore, the user can determine a direction of the prompt sound according to the left alarm prompt sound and the right alarm prompt sound, so that user experience is improved.

Optionally, the operation information to be executed includes performing speech recognition processing on the ambient sound; and the performing an operation according to the operation information to be executed and a subsequently received ambient sound, and obtaining an operated signal specifically includes any one or any combination of the following items:

performing speech recognition on the ambient sound, determining a virtual prompt sound corresponding to a recognized speech according to the recognized speech, and using the virtual prompt sound as the operated signal, so that speech information in the ambient sound may be more clearly fed back to the user;

performing speech recognition on the subsequently received ambient sound, increasing an amplitude of the recognized speech to obtain an amplitude-increased speech, and using the amplitude-increased speech as the operated signal, so that when a noise in the ambient sound is extremely high, or when the user has hearing impairment, volume of a voice of other people may be effectively increased, thereby achieving an effect of a hearing aid for the user; or performing speech recognition on the subsequently received ambient sound, when it is determined that a language form of a recognized speech is inconsistent with a preset language form, translating the recognized speech into a speech corresponding to the preset language form, and using the translated speech as the operated signal. Optionally, translation of the recognized language may be implemented by using translation software, so as to provide various services for the user. Optionally, after the speech is recognized, the speech may further be recorded and saved.

Optionally, after the performing an operation according to the operation information to be executed and a subsequently received ambient sound, and obtaining an operated signal, the method further includes:

converting the recognized human language into text information, and displaying the converted text information on the user equipment; or converting the recognized human language into text information, when it is determined that a language form of the converted text information is inconsistent with the preset language form, translating the converted text information into text information corresponding to the preset language form, and displaying the text information corresponding to the preset language form on the user equipment. Optionally, after recognizing the speech, the processing device may further remind, by means of ringing or vibration on the user equipment, the user to notice the recognized speech.

For example, the recognized human speech is displayed on a mobile phone screen of the user. In this way, the user may more clearly determine speech content in the ambient sound, and various services may be better performed for people who have hearing impairment.

Optionally, the operation information to be executed includes performing noise reduction processing on the ambient sound; and the performing an operation according to the operation information to be executed and a subsequently received ambient sound, and obtaining an operated signal specifically includes:

generating, according to the subsequently received ambient sound, a phase-inverted sound wave used for noise reduction on the subsequently received ambient sound, and using the phase-inverted sound wave as the operated signal.

The phase-inverted sound wave is generated according to the received ambient sound, and the processing device transmits the phase-inverted sound wave to the human ears, so that the phase-inverted sound wave and the ambient sound that enters the human ears cancel each other, and an effect of noise reduction is implemented. Optionally, generation and transmission of the phase-inverted sound wave may be implemented by using a customized hardware channel.

Optionally, before the determining a time-frequency spectrum of an ambient sound in preset duration according to the received ambient sound in the preset duration, the method further includes: determining the headset is worn on the head of the user.

In this way, when the user does not wear the headset, processing on the ambient sound may be stopped, so that energy consumption is reduced, and resources are saved.

Optionally, the processing device receives a sound that is obtained by mixing a mixed signal that is received by a left feedback microphone and a right feedback microphone with the ambient sound heard by the human ears; analyzes the sound that is obtained by mixing the received mixed signal with the ambient sound heard by the human ears; adjusts the operated signal according to the obtained analysis result; and mixes an adjusted operation signal with the audio signal played by the user equipment, to obtain a corrected mixed signal, and transmits the corrected mixed signal to the headset.

In this way, the corrected mixed signal is transmitted to the headset, so that an effect of noise reduction on the ambient sound heard by the human ears is better, and the user better enjoys music or other audio in the audio signal. Therefore, user experience is further improved.

An embodiment of the present invention provides a processing device for processing an ambient sound, including:

a receiving unit, configured to receive an ambient sound;

a determining unit, configured to: determine a time-frequency spectrum of the ambient sound in preset duration according to the received ambient sound in the preset duration; determine a matching scenario from a time-frequency spectrum of at least one preset scenario according to the time-frequency spectrum of the ambient sound in the preset duration; and determine operation information corresponding to the matching scenario as operation information to be executed, where a time-frequency spectrum of the matching scenario matches the time-frequency spectrum of the ambient sound in the preset duration;

a processing unit, configured to: perform an operation according to the operation information to be executed and a subsequently received ambient sound, and determine an operated signal;

a mixing unit, configured to mix the operated signal with an audio signal played by user equipment, to obtain a mixed signal; and a sending unit, configured to transmit the mixed signal to a headset.

Because some sporadic sounds may exist, it is inaccurate to analyze a scenario in which a user stays only according to a sound included in the ambient sound. Based on this, in this embodiment of the present invention, analysis is performed according to the time-frequency spectrum of the ambient sound in the preset duration, so that accuracy of recognition of the ambient sound is further improved. Then, when the matching scenario is determined from the at least one preset scenario according to the time-frequency spectrum of the ambient sound in the preset duration, a matching scenario that is closest to a real scenario in which the user stays can be determined. Then, when the operation is performed according to the operation information corresponding to the matching scenario, that is, the operation is performed according to the real scenario in which the user stays, so that a more accurate operation is performed on the ambient sound according to the scenario in which the user stays, and a more accurate prompt and a better service are provided for the user.

Optionally, the determining unit is specifically configured to:

perform normalized cross correlation on the time-frequency spectrum of the ambient sound in the preset duration and a time-frequency spectrum of each scenario in the at least one preset scenario, to obtain at least one cross correlation value;

if a largest cross correlation value in the at least one cross correlation value is greater than a cross correlation threshold, determine a scenario corresponding to the largest cross correlation value as an alternative scenario, where at least one characteristic spectrum is preset for the alternative scenario, and the characteristic spectrum of the alternative scenario includes all or a part of a time-frequency spectrum of the alternative scenario;

determine energy of each characteristic spectrum in the at least one characteristic spectrum from the time-frequency spectrum of the ambient sound in the preset duration;

determine average energy of all characteristic spectrums of the ambient sound in the preset duration according to energy of each characteristic spectrum of the ambient sound in the preset duration; and when it is determined that the average energy is greater than an energy threshold, determine the alternative scenario as the matching scenario.

Optionally, the operation information to be executed includes performing signal enhancement processing on the ambient sound; and the processing unit is specifically configured to:

determine, according to the subsequently received ambient sound, a prompt sound used for reminding a user to notice the subsequently received ambient sound, and use the prompt sound as the operated signal; and if a power value of an ambient sound that is on a preset frequency band and that is included in the subsequently received ambient sound is greater than a power threshold, generate, according to the subsequently received ambient sound, a phase-inverted sound wave used for noise reduction on the subsequently received ambient sound, and use the phase-inverted sound wave as the operated signal, where the preset frequency band is a preset frequency range of at least one noise.

Optionally, the operation information to be executed includes performing signal enhancement processing on the ambient sound; and the processing unit is specifically configured to:

perform filtering on the subsequently received ambient sound by using a filter, to obtain a filtered ambient sound, and use the filtered ambient sound as the operated signal. The processing unit is further configured to: after obtaining the operated signal, if a power value of an ambient sound that is on a preset frequency band and that is included in the subsequently received ambient sound is greater than a power threshold, generate, according to the subsequently received ambient sound, a phase-inverted sound wave used for noise reduction on the subsequently received ambient sound, and use the phase-inverted sound wave as the operated signal, where the preset frequency band is a preset frequency range of at least one noise. Further, the processing unit is further configured to: before the performing filtering on the subsequently received ambient sound by using a filter, to obtain a filtered ambient sound, perform compensation on the preset frequency response of the filter according to a preset frequency response of the filter, and a frequency response of the phase-inverted sound wave used for noise reduction on the subsequently received ambient sound, to obtain a compensated frequency response; and perform, by using the filter, filtering on the ambient sound that is on the preset frequency band and that is of the ambient sound by using the compensated frequency response, to obtain the filtered ambient sound.

Optionally, the operation information to be executed includes prompting a direction of the ambient sound; and the processing unit is specifically configured to:

determine a phase difference and an amplitude difference between the subsequently received ambient sound that is received by a left sound pickup microphone of the headset and the subsequently received ambient sound that is received by a right sound pickup microphone of the headset; and determine, according to the determined phase difference and amplitude difference, a left alarm prompt sound that needs to be output to an audio-left channel of the headset, and a right alarm prompt sound that needs to be output to an audio-right channel of the headset; and use the left alarm prompt sound and the right alarm prompt sound as the operated signal, where a phase difference between the left alarm prompt sound and the right alarm prompt sound is the same as the determined phase difference between the subsequently received ambient sound that is received by the left sound pickup microphone and the subsequently received ambient sound that is received by the right sound pickup microphone of the headset; and an amplitude difference between the left alarm prompt sound and the right alarm prompt sound is the same as the determined amplitude difference between the subsequently received ambient sound that is received by the left sound pickup microphone and the subsequently received ambient sound that is received by the right sound pickup microphone of the headset.

Optionally, the operation information to be executed includes performing speech recognition processing on the ambient sound; and the processing unit is specifically configured to perform any one or any combination of the following items:

performing speech recognition on the ambient sound, determining a virtual prompt sound corresponding to a recognized speech according to the recognized speech, and using the virtual prompt sound as the operated signal;

performing speech recognition on the subsequently received ambient sound, increasing an amplitude of the recognized speech to obtain an amplitude-increased speech, and using the amplitude-increased speech as the operated signal; or performing speech recognition on the subsequently received ambient sound, when it is determined that a language form of a recognized speech is inconsistent with a preset language form, translating the recognized speech into a speech corresponding to the preset language form, and using the translated speech as the operated signal.

Optionally, after the performing an operation according to the operation information to be executed and a subsequently received ambient sound, and obtaining an operated signal, the processing unit is further configured to:

convert the recognized human language into text information, and display the converted text information on the user equipment; or convert the recognized human language into text information, when it is determined that a language form of the converted text information is inconsistent with the preset language form, translate the converted text information into text information corresponding to the preset language form, and display the text information corresponding to the preset language form on the user equipment.

Optionally, the operation information to be executed includes performing noise reduction processing on the ambient sound; and the processing unit is specifically configured to:

generate, according to the subsequently received ambient sound, a phase-inverted sound wave used for noise reduction on the subsequently received ambient sound, and use the phase-inverted sound wave as the operated signal.

Optionally, the mixing unit is configured to: receive, by using the receiving unit, a sound that is obtained by mixing a mixed signal that is received by a left feedback microphone and a right feedback microphone with the ambient sound heard by the human ears; analyze the sound that is obtained by mixing the received mixed signal with the ambient sound heard by the human ears; adjust the operated signal according to the obtained analysis result; and mix the adjusted operation signal with the audio signal played by the user equipment, to obtain a corrected mixed signal, and transmit the corrected mixed signal into the headset by using the sending unit.

An embodiment of the present invention provides a processing device for processing an ambient sound, including:

a receiver, configured to receive an ambient sound;

a processor, configured to: determine a time-frequency spectrum of the ambient sound in preset duration according to the ambient sound in the preset duration that is received by the receiver; determine a matching scenario from a time-frequency spectrum of at least one preset scenario according to the time-frequency spectrum of the ambient sound in the preset duration; determine operation information corresponding to the matching scenario as operation information to be executed; perform an operation according to the operation information to be executed and a subsequently received ambient sound, and determine an operated signal; and mix the operated signal with an audio signal played by user equipment, to obtain a mixed signal, and transmit the mixed signal into a headset by using a transmitter, where a time-frequency spectrum of the matching scenario matches the time-frequency spectrum of the ambient sound in the preset duration;

the transmitter, configured to transmit the mixed signal to the headset under control of the processor; and a memory, configured to store the time-frequency spectrum of the at least one preset scenario, and the operation information corresponding to the matching scenario.

Because some sporadic sounds may exist, it is inaccurate to analyze a scenario in which a user stays only according to a sound included in the ambient sound. Based on this, in this embodiment of the present invention, analysis is performed according to the time-frequency spectrum of the ambient sound in the preset duration, so that accuracy of recognition of the ambient sound is further improved. Then, when the matching scenario is determined from the at least one preset scenario according to the time-frequency spectrum of the ambient sound in the preset duration, a matching scenario that is closest to a real scenario in which the user stays can be determined. Then, when the operation is performed according to the operation information corresponding to the matching scenario, that is, the operation is performed according to the real scenario in which the user stays, so that a more accurate operation is performed on the ambient sound according to the scenario in which the user stays, and a more accurate prompt and a better service are provided for the user.

Optionally, the processor is specifically configured to:

perform normalized cross correlation on the time-frequency spectrum of the ambient sound in the preset duration and a time-frequency spectrum of each scenario in the at least one preset scenario, to obtain at least one cross correlation value;

if a largest cross correlation value in the at least one cross correlation value is greater than a cross correlation threshold, determine a scenario corresponding to the largest cross correlation value as an alternative scenario, where at least one characteristic spectrum is preset for the alternative scenario, and the characteristic spectrum of the alternative scenario includes all or a part of a time-frequency spectrum of the alternative scenario;

determine energy of each characteristic spectrum in the at least one characteristic spectrum from the time-frequency spectrum of the ambient sound in the preset duration;

determine average energy of all characteristic spectrums of the ambient sound in the preset duration according to energy of each characteristic spectrum of the ambient sound in the preset duration; and when it is determined that the average energy is greater than an energy threshold, determine the alternative scenario as the matching scenario.

The characteristic spectrum includes all or some of the spectrums included in both the time-frequency spectrum of the ambient sound in the preset duration and the time-frequency spectrum corresponding to the alternative scenario.

Optionally, the operation information to be executed includes performing signal enhancement processing on the ambient sound; and the processor is specifically configured to:

determine, according to the subsequently received ambient sound, a prompt sound used for reminding a user to notice the subsequently received ambient sound, and use the prompt sound as the operated signal; and if a power value of an ambient sound that is on a preset frequency band and that is included in the subsequently received ambient sound is greater than a power threshold, generate, according to the subsequently received ambient sound, a phase-inverted sound wave used for noise reduction on the subsequently received ambient sound, and use the phase-inverted sound wave as the operated signal, where the preset frequency band is a preset frequency range of at least one noise.

Optionally, the operation information to be executed includes performing signal enhancement processing on the ambient sound; and the processor is specifically configured to:

perform filtering on the subsequently received ambient sound by using a filter, to obtain a filtered ambient sound, and use the filtered ambient sound as the operated signal.

Optionally, the processor is specifically configured to:

after the performing an operation according to the operation information to be executed and a subsequently received ambient sound, and obtaining an operated signal, if a power value of an ambient sound that is on a preset frequency band and that is included in the subsequently received ambient sound is greater than a power threshold, generate a phase-inverted sound wave used for noise reduction on the subsequently received ambient sound according to the subsequently received ambient sound, and use the phase-inverted sound wave as the operated signal, where the preset frequency band is a preset frequency range of at least one noise.

Optionally, the processor is specifically configured to:

before the performing filtering on the subsequently received ambient sound by using a filter, to obtain a filtered ambient sound, perform compensation on the preset frequency response of the filter according to a preset frequency response of the filter, and a frequency response of the phase-inverted sound wave used for noise reduction on the subsequently received ambient sound, to obtain a compensated frequency response; and perform, by using the filter, filtering on the ambient sound that is on the preset frequency band and that is of the ambient sound by using the compensated frequency response, to obtain the filtered ambient sound.

Optionally, the operation information to be executed includes prompting a direction of the ambient sound; and the processor is specifically configured to:

determine a phase difference and an amplitude difference between the subsequently received ambient sound that is received by a left sound pickup microphone of the headset and the subsequently received ambient sound that is received by a right sound pickup microphone of the headset; and determine, according to the determined phase difference and amplitude difference, a left alarm prompt sound that needs to be output to an audio-left channel of the headset, and a right alarm prompt sound that needs to be output to an audio-right channel of the headset; and use the left alarm prompt sound and the right alarm prompt sound as the operated signal, where a phase difference between the left alarm prompt sound and the right alarm prompt sound is the same as the determined phase difference between the subsequently received ambient sound that is received by the left sound pickup microphone and the subsequently received ambient sound that is received by the right sound pickup microphone of the headset; and an amplitude difference between the left alarm prompt sound and the right alarm prompt sound is the same as the determined amplitude difference between the subsequently received ambient sound that is received by the left sound pickup microphone and the subsequently received ambient sound that is received by the right sound pickup microphone of the headset.

Optionally, the operation information to be executed includes performing speech recognition processing on the ambient sound; and the processor is specifically configured to perform any one or any combination of the following items:

performing speech recognition on the ambient sound, determining a virtual prompt sound corresponding to a recognized speech according to the recognized speech, and using the virtual prompt sound as the operated signal;

performing speech recognition on the subsequently received ambient sound, increasing an amplitude of the recognized speech to obtain an amplitude-increased speech, and using the amplitude-increased speech as the operated signal; or performing speech recognition on the subsequently received ambient sound, when it is determined that a language form of a recognized speech is inconsistent with a preset language form, translating the recognized speech into a speech corresponding to the preset language form, and using the translated speech as the operated signal.

Optionally, after the performing an operation according to the operation information to be executed and a subsequently received ambient sound, and obtaining an operated signal, the processor is further configured to:

convert the recognized human language into text information, and display the converted text information on the user equipment; or convert the recognized human language into text information, when it is determined that a language form of the converted text information is inconsistent with the preset language form, translate the converted text information into text information corresponding to the preset language form, and display the text information corresponding to the preset language form on the user equipment.

Optionally, the operation information to be executed includes performing noise reduction processing on the ambient sound; and the processor is specifically configured to:

generate, according to the subsequently received ambient sound, a phase-inverted sound wave used for noise reduction on the subsequently received ambient sound, and use the phase-inverted sound wave as the operated signal.

Optionally, the processor is configured to: receive, by using the receiver, a sound that is obtained by mixing a mixed signal that is received by a left feedback microphone and a right feedback microphone with the ambient sound heard by the human ears; analyze the sound that is obtained by mixing the received mixed signal with the ambient sound heard by the human ears; adjust the operated signal according to the obtained analysis result; and mix the adjusted operation signal with the audio signal played by the user equipment, to obtain a corrected mixed signal, and transmit the corrected mixed signal into the headset by using the transmitter.

In this embodiment of the present invention, the time-frequency spectrum of the ambient sound in the preset duration is determined according to the received ambient sound in the preset duration; the matching scenario is determined from the time-frequency spectrum of the at least one preset scenario according to the time-frequency spectrum of the ambient sound in the preset duration, where the time-frequency spectrum of the matching scenario matches the time-frequency spectrum of the ambient sound in the preset duration; the operation information corresponding to the matching scenario is determined as the operation information to be executed; the operation is performed according to the operation information to be executed and the subsequently received ambient sound, and the operated signal is determined; and the operated signal is mixed with the audio signal played by the user equipment, to obtain the mixed signal, and the mixed signal is transmitted to the headset. Because some sporadic sounds may exist, it is inaccurate to analyze a scenario in which a user stays only according to a sound included in the ambient sound. Based on this, in this embodiment of the present invention, analysis is performed according to the time-frequency spectrum of the ambient sound in the preset duration, so that accuracy of recognition of the ambient sound is further improved. Then, when the matching scenario is determined from the at least one preset scenario according to the time-frequency spectrum of the ambient sound in the preset duration, a matching scenario that is closest to a real scenario in which the user stays can be determined. Then, when the operation is performed according to the operation information corresponding to the matching scenario, that is, the operation is performed according to the real scenario in which the user stays, so that a more accurate operation is performed on the ambient sound according to the scenario in which the user stays, and a more accurate prompt and a better service are provided for the user.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and persons of ordinary skill in the art may still derive other drawings from these accompanying drawings without creative efforts.

DESCRIPTION OF EMBODIMENTS

To make the objectives, technical solutions, and advantages of the present invention clearer and more comprehensible, the following further describes the present invention in detail with reference to the accompanying drawings and embodiments. It should be understood that the specific embodiments described herein are merely used to explain the present invention but are not intended to limit the present invention.

Figure 1A:
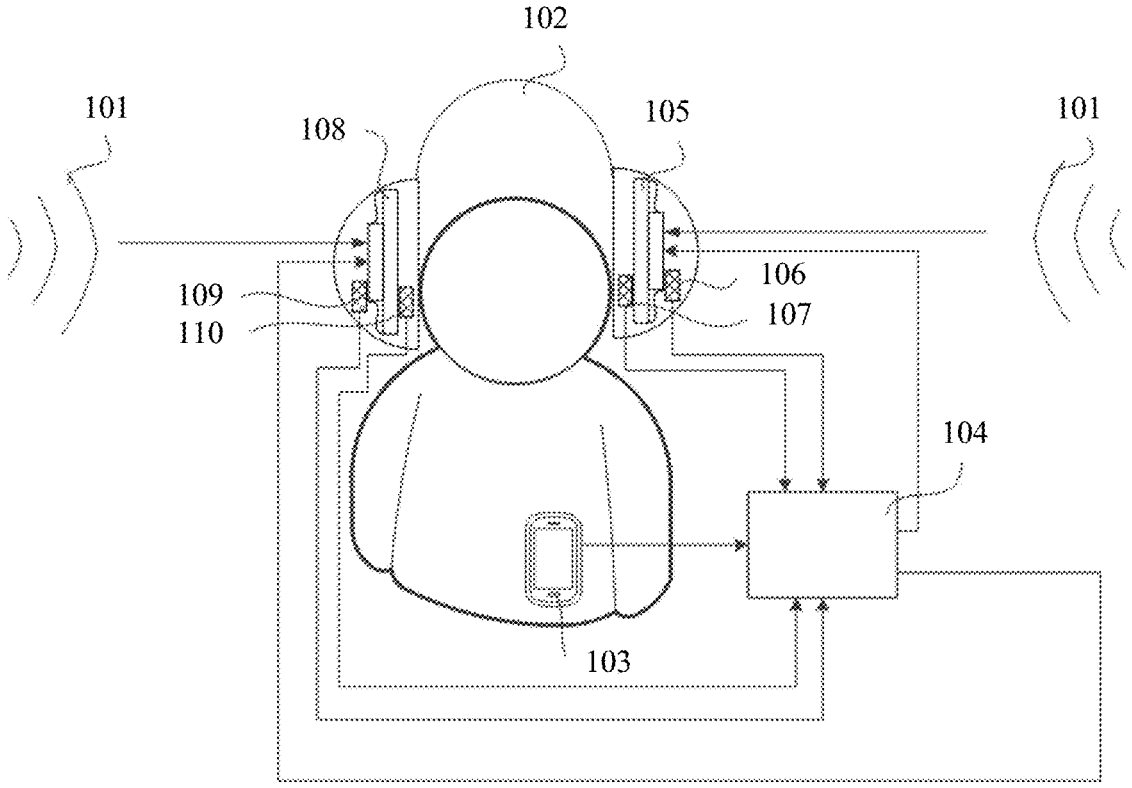
FIG. 1*a* is a schematic diagram of a system architecture that is applied to an embodiment of the present invention.

FIG. 1*a* shows a schematic diagram of an example system architecture that is applied to an embodiment of the present invention. As shown in FIG. 1*a*, the system architecture includes user equipment 103, a headset 102, and a processing device 104. The processing device 104 may be integrated into the headset 102, the processing device 104 may be integrated into the user equipment 103, or the processing device 104 is a device that is independent of the headset 102 and the user equipment 103. The headset 102 is divided into a left and a right side. The left side of the headset includes a left loudspeaker 108 and a left sound pickup microphone 109, and the right side of the headset includes a right loudspeaker 105 and a right sound pickup microphone 106. Optionally, the left side of the headset further includes a left feedback microphone 110, and the right side of the headset further includes a right feedback microphone 107.

In this embodiment of the present invention, the user equipment 103 inputs, to the processing device 104, an audio signal played by the user equipment 103. The processing device 104 further receives an ambient sound 101 by using the left sound pickup microphone 109 and the right sound pickup microphone 106, determines, according to the received ambient sound, operation information to be executed, performs an operation according to the operation information to be executed and the received ambient sound, and determines an operated signal. The operation information to be executed includes any one or any combination of the following items: performing signal enhancement processing on the ambient sound, prompting a direction of the ambient sound, performing speech recognition processing on the ambient sound, or performing noise reduction processing on the ambient sound. The processing device mixes the operated signal with the audio signal played by the user equipment 103, to obtain a mixed signal, and inputs the mixed signal to the left loudspeaker 108 and the right loudspeaker 105, so that a user hears the mixed signal. Optionally, the processing device 104 may receive, by using the left feedback microphone 110, a sound output from the left loudspeaker 108, and receive, by using the right feedback microphone 107, a sound output from the right loudspeaker 105. The left feedback microphone 110 is located between an ear and the left loudspeaker 108, and therefore, the sound received by the left feedback microphone 110 is a sound heard by a left ear of a person. The right feedback microphone 107 is located between an ear and the right loudspeaker 105, and therefore, the sound received by the right feedback microphone 107 is a sound heard by a right ear of the person. Therefore, the processing device may adjust the mixed signal according to the sounds received by the left feedback microphone 110 and the right feedback microphone 107, so as to improve quality of the mixed signal heard by the user, and further improve user experience.

In this embodiment of the present invention, the ambient sound first passes through the right sound pickup microphone 106, then passes through the right loudspeaker 105, and finally passes through the right feedback microphone 107. When the ambient sound 101 enters the ear of the person by using the headset, volume is weakened. Therefore, the right sound pickup microphone 106 is located on an external side of the loudspeaker, and may be configured to receive a clearer ambient sound that has not entered the headset. In addition, there is almost no obstruction outside the right sound pickup microphone 106, and therefore, the ambient sound may be better collected. Similarly, the ambient sound first passes through the left sound pickup microphone 109, then passes through the left loudspeaker 108, and finally passes through the left feedback microphone 110. When the ambient sound 101 enters the ear of the person by using the headset, volume is weakened. Therefore, the left sound pickup microphone 109 is located on an external side of the loudspeaker, and may be configured to receive a clearer ambient sound that has not entered the headset. In addition, there is almost no obstruction outside the left sound pickup microphone 109, and therefore, the ambient sound may be better collected.

Figure 1B:
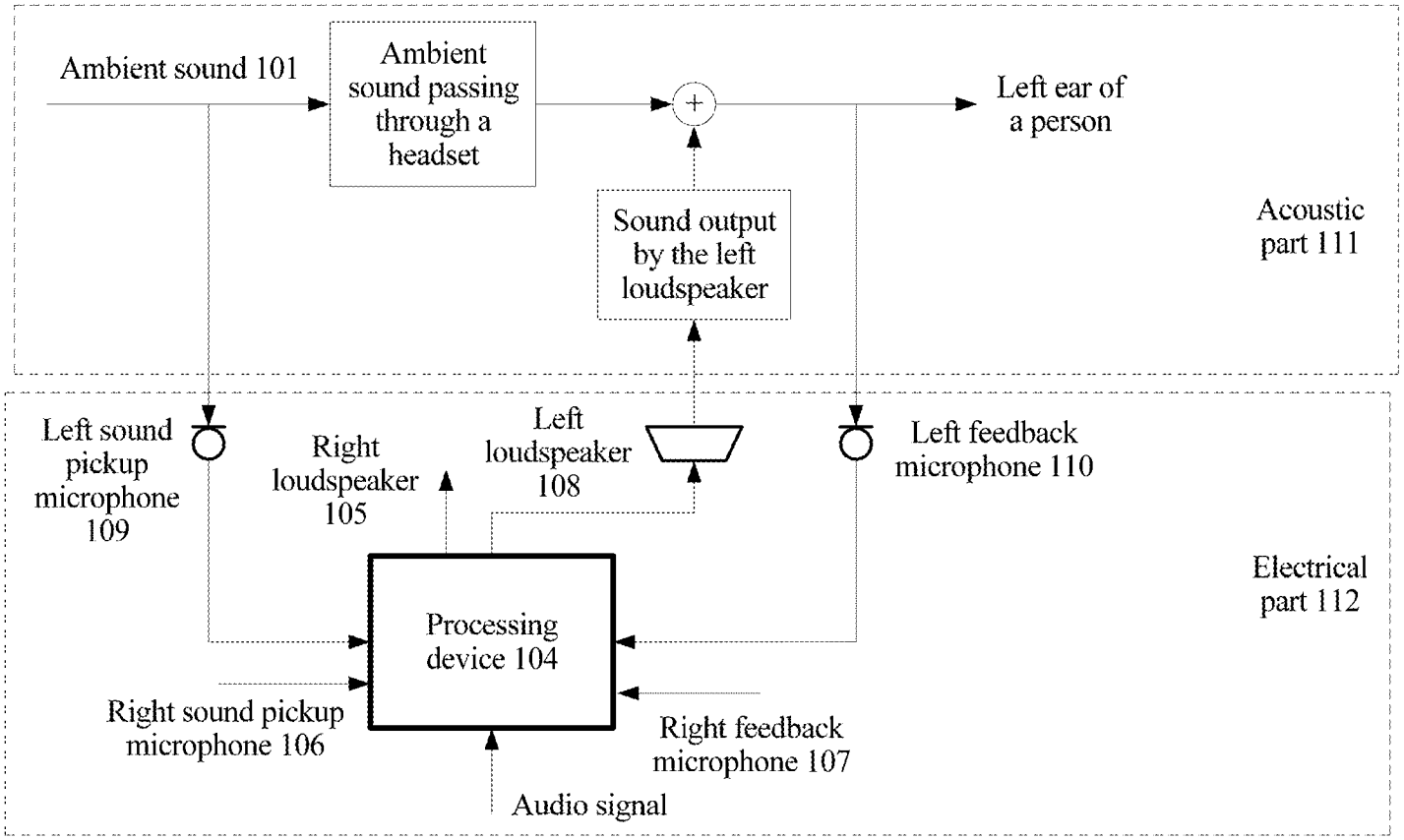
FIG. 1*b* is a schematic diagram of an equivalent circuit of the system architecture shown in FIG. 1*a;*

FIG. 1*b* shows an example of an equivalent circuit diagram of the system architecture shown in FIG. 1. As shown in FIG. 1*b*, the system may be divided into two parts: an acoustic part 111 and an electrical part 112. The ambient sound 101 is transmitted to the left ear by means of space propagation, and the model is equivalent to that the ambient sound 101 passes through a filter related to an earbud head, so that the ambient sound 101 that passes through the headset and enters the left ear is weakened. In addition, the ambient sound 101 is received by the left sound pickup microphone 109, and is input to the processing device 104. The processing device receives the ambient sound that is input by the left sound pickup microphone 109 and the right sound pickup microphone 106, performs a series of operations to obtain an operated signal, mixes the operated signal with an audio signal to obtain a mixed signal, and separately inputs the mixed signal to the left loudspeaker 108 and the right loudspeaker 105. The processing device 104 outputs an electrical signal. The left loudspeaker 108 converts the received electrical signal into a sound signal. The converted sound signal is superposed, by means of space propagation, on the external ambient sound that passes through the headset, to become a sound that the user finally hears. Optionally, the left feedback microphone 110 is disposed on a side towards the ear of the earbud head. The sound signal that the user finally hears is collected, and the collected sound signal that the user finally hears is fed back to the processing device, so that the processing device performs adjustment, and the user finally hears a better sound.

The user equipment used in this embodiment of the present invention is a device that can play audio, for example, a handheld device, an in-vehicle device, a wearable device, or a computing device that can play audio, a user equipment (User Equipment, UE for short), a mobile station (Mobile station, MS for short), a terminal (terminal), or a terminal device (Terminal Equipment), Specifically, for example, a mobile phone, a tablet computer, a Moving Picture Experts Group audio layer 3 (Moving Picture Experts Group Audio Layer 3, MP3 for short), a Moving Picture Experts Group audio layer 4 (Moving Picture Experts Group Audio Layer 4, MP4 for short), a radio set, and a recorder. For ease of description, in this application, these devices are simply referred to as user equipment.

The audio played by the user equipment in this embodiment of the present invention is music, an audio novel, audio of an entertainment program, or the like that the user expects to hear. After being processed by the processing device 104, the audio enters the left ear of a person by passing through the left loudspeaker 108, and enters the right ear of the person by passing through the right loudspeaker 105. The processing device 104 in this embodiment of the present invention may be a processing device 400 in FIG. 4. The processing device 104 is configured to: analyze a time-frequency spectrum of an ambient sound in preset duration with reference to an algorithm, perform some operations, and input a mixed signal.

Figure 4:
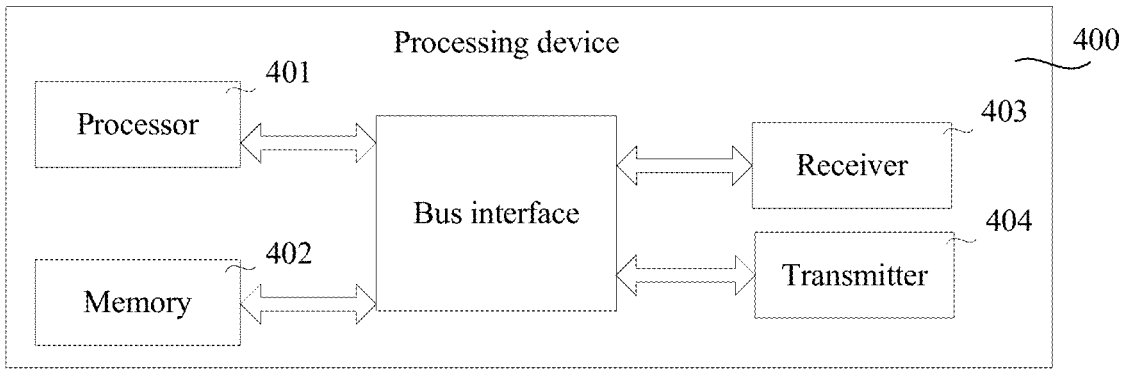
FIG. 4 is a schematic structural diagram of another processing device for processing an ambient sound according to an embodiment of the present invention.

A processor 401 included in the processing device 400 in FIG. 4 may be a central processing unit (Central Processing Unit, CPU for short) or a digital signal processor (Digital Signal Process, DSP for short). In specific implementation, the processor 401 included in the processing device 400 in FIG. 4 may be a processor that is built into the headset; may be an external processor connected to the headset; or may be a processor inside the user equipment that is used for playing an audio signal, and in this case, the processor of the user equipment used for playing the audio signal may perform analysis and operation on the ambient sound by using a customized headset plug or an interface protocol chip.

Figure 2:
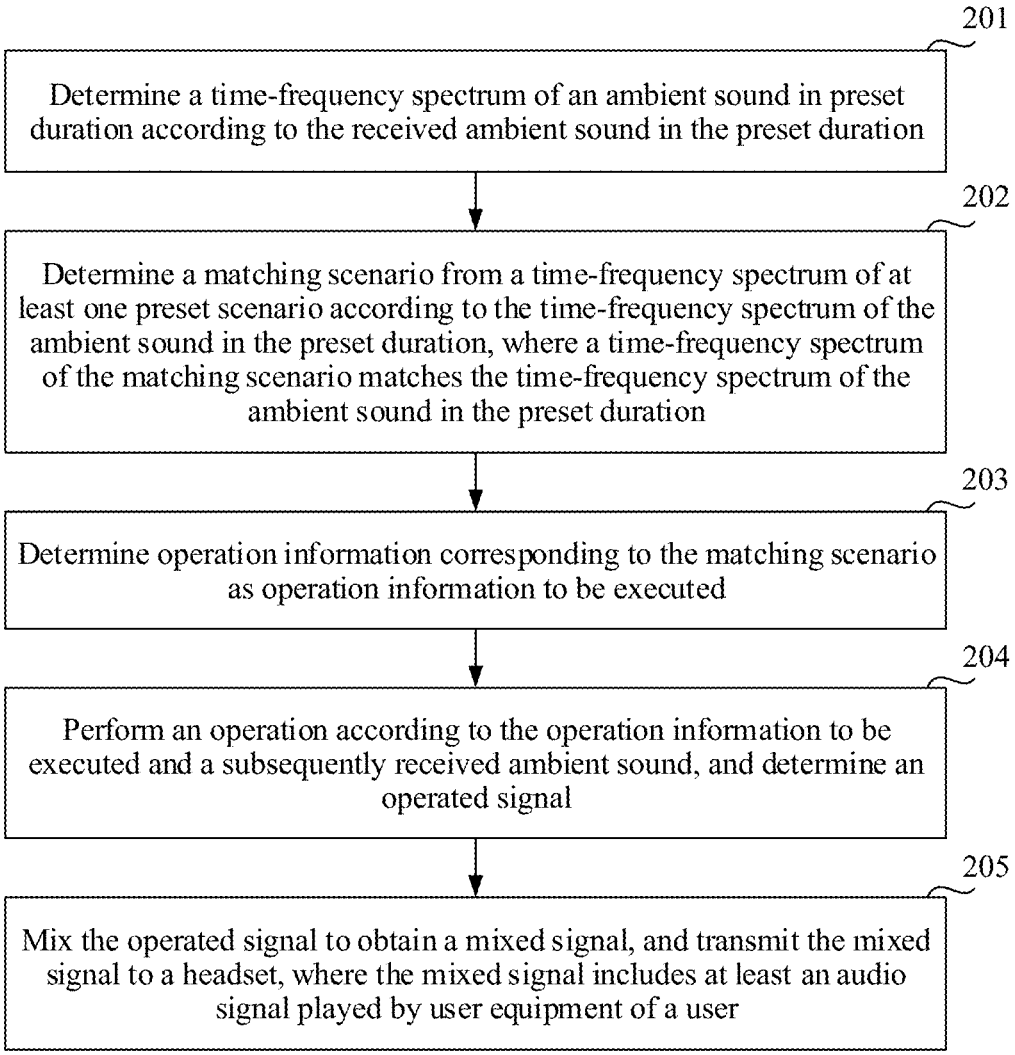
FIG. 2 is a schematic flowchart of an ambient sound processing method according to an embodiment of the present invention.

Based on the system architectures shown in FIG. 1*a* and FIG. 1*b*, FIG. 2 shows an ambient sound processing method that may be executed by a processing device according to an embodiment of the present invention. The processing device that executes the method may be the processing device 400 in FIG. 4. Specifically, the processor 401 in the processing device 400 reads a program stored in the memory 402 to perform the following method procedure with coordination from a receiver 403 and a transmitter 404. The method includes the following steps:

Step 201: The processing device determines a time-frequency spectrum of an ambient sound in preset duration according to the ambient sound in the preset duration that is received by the processing device.

Step 202: The processing device determines a matching scenario from a time-frequency spectrum of at least one preset scenario according to the time-frequency spectrum of the ambient sound in the preset duration, where a time-frequency spectrum of the matching scenario matches the time-frequency spectrum of the ambient sound in the preset duration.

Step 203: The processing device determines operation information corresponding to the matching scenario as operation information to be executed.

Step 204: The processing device performs an operation according to the operation information to be executed and a subsequently received ambient sound, and determines an operated signal.

Step 205: The processing device mixes the operated signal to obtain a mixed signal, and transmits the mixed signal to a headset, where the mixed signal includes at least an audio signal played by user equipment of a user.

Specifically, in step 201, the processing device periodically performs step 201 to step 203 on the received ambient sound. In each period, after determining, according to a received ambient sound in preset duration, operation information to be executed, the processing device may perform, in a current period, an operation on a subsequently received ambient sound in the current period according to the determined operation information to be executed until a next period begins. For example, at a first moment of a first period, the processing device performs step 201 to step 203 on an ambient sound in preset duration that is received at the first moment of the first period, and determines first operation information to be executed. For example, the operation information to be executed is performing speech recognition processing on the ambient sound. In this case, in the remaining time of the first period, the processing device performs speech recognition processing on a subsequently received ambient sound, and determines a recognized speech as the operated signal. For another example, if the operation information to be executed is performing noise reduction processing on the ambient sound, the processing device needs to generate a phase-inverted sound wave used for canceling the subsequently received ambient sound in the remaining time of the first period, and determines the generated phase-inverted sound wave as the operated signal. When a first moment of a second period arrives, the processing device performs step 201 to step 203 on an ambient sound that is received from the first moment of the second period, and determines second operation information to be executed. In this case, in the remaining time of the second period, the processing device performs an operation on a subsequently received ambient sound according to the second operation information to be executed, and determines the operated signal.

Because some sporadic sounds may exist, it is inaccurate to analyze a scenario in which the user stays only according to a sound included in the ambient sound. Based on this, in this embodiment of the present invention, analysis is performed according to the time-frequency spectrum of the ambient sound in the preset duration, so that accuracy of recognition of the ambient sound is further improved. Then, when the matching scenario is determined from the at least one preset scenario according to the time-frequency spectrum of the ambient sound in the preset duration, a matching scenario that is closest to a real scenario in which the user stays can be determined. Then, when the operation is performed according to the operation information corresponding to the matching scenario, that is, the operation is performed according to the real scenario in which the user stays, so that a more accurate operation is performed on the ambient sound according to the scenario in which the user stays, and a more accurate prompt and a better service are provided for the user.

In this embodiment of the present invention, the processing device determines the operation information to be executed by using step 201 to step 203. Specifically, the processing device in this embodiment of the present invention determines the matching scenario from the at least one preset scenario according to the time-frequency spectrum of the ambient sound in the preset duration, where the time-frequency spectrum of the matching scenario matches the time-frequency spectrum of the ambient sound in the preset duration; and then determines the operation information corresponding to the matching scenario as the operation information to be executed.

An embodiment of the present invention further provides another implementation. One or more working modes may be preset, and operation information corresponding to each working mode is determined as operation information to be executed. In specific implementation, some switches may be disposed, so that a user can flexibly enable or disable the one or more working modes by using these switches. After startup, the processing device first obtains control information from a memory, for example, working modes that are enabled by the user in advance. The working modes that may be enabled or disabled include: a working mode of recognizing a scenario, a working mode of performing signal enhancement processing on the ambient sound, a working mode of prompting a direction of the ambient sound, a working mode of performing speech recognition processing on the ambient sound, a working mode of performing noise reduction processing on the ambient sound, and the like. The user may enable one or more of the working modes.

After startup, the processing device enters the enabled preset working mode, determines the corresponding operation information in each working mode, and uses the determined operation information as the operation information to be executed. Specifically, if the user enables the scenario recognition mode in advance, the processing device performs step 201 to step 203, and determines operation information corresponding to a matching scenario as the operation information to be executed. If the user enables the working mode of performing signal enhancement processing on the ambient sound in advance, the operation information to be executed is performing signal enhancement processing on the ambient sound. If the user enables the working mode of prompting a direction of the ambient sound in advance, the operation information to be executed is prompting a direction of the ambient sound. If the user enables the working mode of performing speech recognition processing on the ambient sound in advance, the operation information to be executed is performing speech recognition processing on the ambient sound. If the user enables the working mode of performing noise reduction processing on the ambient sound in advance, the operation information to be executed is performing noise reduction processing on the ambient sound.

Optionally, in this embodiment of the present invention, when the working mode of recognizing a scenario is disabled, the processing device no longer performs step 201 to step 203 on the received ambient sound, and works only according to another working mode preset by the user, or, according to user settings, only transmits the audio signal without processing the ambient sound. In this embodiment of the present invention, an example in which the user enables the working mode of recognizing a scenario in advance is used for description.

Optionally, the memory further stores each parameter that is used in a process of processing the ambient sound, for example, a parameter of a filter. The user may modify these parameters, or may use a default value.

Optionally, before step 201, after startup, the processing device determines whether the headset is worn on a head of the user. If the headset is not worn on the head, the user may have taken off the headset, and in this case, the ambient sound is not processed. When it is determined that the headset is worn on the head of the user, step 201 is performed. In this way, when the user does not wear the headset, processing on the ambient sound may be stopped, so that energy consumption is reduced, and resources are saved.

Optionally, a sensor may be disposed on an earbud head of the headset to determine whether the headset is worn on the head of the user, where the earbud head of the headset is a part that is of the headset and that is in contact with an ear of the user. Alternatively, the ambient sound heard by two ears may be analyzed with reference to an algorithm, for example, an algorithm based on a head related transfer function (Head Related Transfer Function, HRTF for short).

In specific implementation, the processing device performs frame division processing on the ambient sound in the preset duration, and divides the ambient sound into audio frames. The audio frame is a basic unit for processing, and data of 10 milliseconds (millisecond, ms for short) or 20 ms is generally selected. A spectrum of each audio frame is obtained by performing some operations on the audio frame, for example, a fast Fourier transformation (Fast Fourier Transformation, FFT for short) operation. A granularity of the spectrum in a frequency domain may be selected according to system complexity and required accuracy, for example, 256 points. A time-frequency spectrum of the received ambient sound in the preset duration includes the spectrum of the audio frame and previously stored spectrums of multiple audio frames.

Figure 2A:
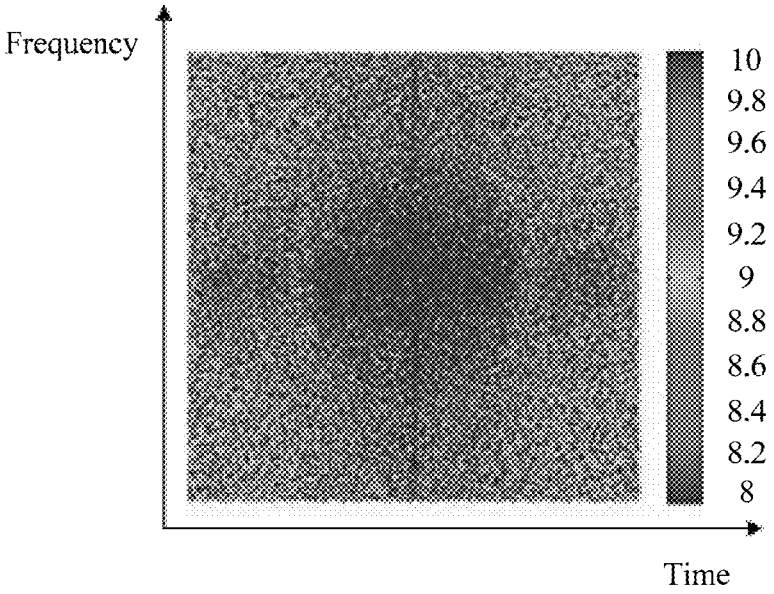
FIG. 2*a* is a schematic diagram of a time-frequency spectrum according to an embodiment of the present invention.

In this embodiment of the present invention, at least one scenario is prestored or preset locally or in the cloud. Each scenario includes a time-frequency spectrum, and each scenario is corresponding to a different time-frequency spectrum. The time-frequency spectrum included in each scenario includes N core frequencies, that is, there is a relatively high probability that the N core frequencies exist in the scenario. Optionally, each scenario is corresponding to at least one characteristic spectrum, and the characteristic spectrum includes some or all of the N core frequencies, where N is a positive integer. For example, a scenario 1 is a road, and a core frequency of a time-frequency spectrum included in the scenario 1 includes frequencies of a sound of a motor, a human voice, and a honk, and in this case, a characteristic spectrum may be a sound whose proportion is largest in the scenario. A proportion of the sound of the motor on the road must be relatively large, and in this case, the characteristic spectrum is the sound of the motor in the core spectrums. Alternatively, the characteristic spectrum is the sound of the motor and the honk. Alternatively, the characteristic spectrum includes all the spectrums in the core frequencies, that is, the characteristic spectrum includes the frequencies of the sound of the motor, the human voice, and the honk. Further, corresponding operation information is preset for each scenario. For example, the scenario 1 is a road, there are honks on the road, and people need to pay attention to the honks, and therefore, preset operation information corresponding to the scenario 1 may be performing signal enhancement processing on the ambient sound. The time-frequency spectrum in this embodiment of the present invention is a frequency of each sound in an ambient sound received by the user in a time period. FIG. 2*a* shows a schematic diagram of an example of a time-frequency spectrum. As shown in FIG. 2*a*, in the time-frequency spectrum, a horizontal axis is a time axis, and a vertical axis is a frequency axis, colors with various shades represent different sounds, and one or more sounds whose proportions are relatively large can be learned from the time-frequency spectrum.

Optionally, in step 202, specifically, the matching scenario is determined by performing the following step:

performing normalized cross correlation on the time-frequency spectrum of the ambient sound in the preset duration that is received by the processing device and a time-frequency spectrum of each scenario in the at least one preset scenario, to obtain at least one cross correlation value. In this embodiment of the present invention, normalized cross correlation (Normalized Correlation, NC for short) may also be referred to as a normalized cross correlation matching algorithm. The normalized cross correlation matching algorithm is a classical statistical algorithm. In this algorithm, a degree of matching between two images is determined by calculating cross correlation values of the two images. Optionally, in this embodiment of the present invention, the matching scenario may be determined for the ambient sound by using an algorithm, for example, a machine learning algorithm or a more complex artificial neural network algorithm.

If a largest cross correlation value in the at least one cross correlation value is greater than a cross correlation threshold, a scenario corresponding to the largest cross correlation value is determined as an alternative scenario. At least one characteristic spectrum is preset for the alternative scenario. The characteristic spectrum of the alternative scenario includes all or a part of a time-frequency spectrum of the alternative scenario. Energy of each characteristic spectrum in the at least one characteristic spectrum is determined from the time-frequency spectrum of the ambient sound in the preset duration. Average energy of all characteristic spectrums of the ambient sound in the preset duration is determined according to energy of each characteristic spectrum of the ambient sound in the preset duration. When it is determined that the average energy is greater than an energy threshold, the alternative scenario is determined as the matching scenario.

Specifically, when a cross correlation value between the time-frequency spectrum of the alternative scenario and the time-frequency spectrum of the ambient sound received by the processing device is greater than the cross correlation threshold, and the preset alternative scenario is corresponding to N core frequencies, the time-frequency spectrum of the ambient sound also definitely includes the N core frequencies corresponding to the alternative scenario. An example is used for description. The core frequency corresponding to the alternative scenario includes frequencies of a sound of a motor, a honk, and a human voice, and in this case, only when the time-frequency spectrum of the ambient sound also includes the frequencies of the sound of the motor, the honk, and the human voice, the cross correlation value between the time-frequency spectrum of the ambient sound and the time-frequency spectrum of the alternative scenario can be greater than the cross correlation threshold, that is, in this case, the time-frequency spectrum of the ambient sound can match the time-frequency spectrum of the alternative scenario. Further, because the characteristic spectrum corresponding to the alternative scenario includes all or some of the N core frequencies corresponding to the alternative scenario, the time-frequency spectrum of the ambient sound also definitely includes the characteristic spectrum corresponding to the alternative scenario. Therefore, when the alternative scenario is determined, energy of each characteristic spectrum in the at least one characteristic spectrum may be determined from the time-frequency spectrum of the ambient sound in the preset duration according to the at least one preset characteristic spectrum corresponding to the alternative scenario.

If the largest cross correlation value in the at least one cross correlation value is not greater than the cross correlation threshold, it indicates that no matching scenario is determined for a real scenario in which the user currently stays. Alternatively, if the largest cross correlation value in the at least one cross correlation value is greater than the cross correlation threshold, but the average energy of all the characteristic spectrums in the ambient sound is not greater than an energy threshold, it indicates that no matching scenario is determined for a real scenario in which the user currently stays.

Both the cross correlation threshold and the energy threshold in this embodiment of the present invention are conventional empirical values. A greater cross correlation value indicates that two time-frequency spectrums better match each other. For example, the cross correlation threshold may be 1. Larger energy of a spectrum indicates that a sound corresponding to the spectrum is louder, and that the user is closer to a source of the sound.

In this embodiment of the present invention, the time-frequency spectrum is used to perform normalized cross correlation, that is, the alternative scenario is determined from two aspects: a time dimension and a sound type included in the ambient sound, and then according to whether the energy of the characteristic spectrum included in the ambient sound is greater than the energy threshold, that is, whether intensity of a sound corresponding to the characteristic spectrum in the ambient sound is high enough. In this way, a degree of matching between the matching scenario and the real scenario in which the user stays may be further improved, that is, the matching scenario is closer to the real scenario in which the user stays.

Optionally, in this embodiment of the present invention, the operation information corresponding to the matching scenario is determined as the operation information to be executed, and the operation information to be executed includes any one or any combination of the following items: performing signal enhancement processing on the ambient sound, prompting a direction of the ambient sound, performing speech recognition processing on the ambient sound, or performing noise reduction processing on the ambient sound. The following describes in detail a corresponding processing method of the processing device when the operation information to be executed is the foregoing content.

Optionally, if the operation information to be executed includes performing noise reduction processing on the ambient sound, the processing device generates a phase-inverted sound wave according to an ambient sound that is subsequently received by the processing device, uses the phase-inverted sound wave as the operated signal, mixes the phase-inverted sound wave with an audio signal to obtain a mixed signal, and transmits the mixed signal to human ears, where the phase-inverted sound wave included in the mixed signal is used for canceling the ambient sound received by the human ears, so that an effect of noise reduction is achieved.

For example, when the user quietly listens to music in a leisure area beside a road, in this case, the user may be affected by a sound of a motor of an automobile, a honk, and a human voice on the road, and preset operation information corresponding to the scenario may be performing noise reduction processing on the ambient sound.

The phase-inverted sound wave is generated according to the received ambient sound, and the processing device transmits the phase-inverted sound wave to the human ears, so that the phase-inverted sound wave and the ambient sound that enters the human ears cancel each other, and an effect of noise reduction is implemented. Optionally, generation and transmission of the phase-inverted sound wave may be implemented by using a customized hardware channel.

Specifically, after the user wears the headset, the ears of the user are plugged with the headset. In this case, the user is insensitive to a key sound in the ambient sound, and consequently, a safety risk is brought. The key sound includes but is not limited to a honk of an automobile, a prompt sound, yelling of other people, and the like. In this embodiment of the present invention, signal enhancement processing may be performed on the ambient sound in a scenario in which the key sound exists, so that the user can also notice the key sound in the ambient sound when enjoying an audio signal.

If the operation information to be executed includes performing signal enhancement processing on the ambient sound, multiple implementations are included. This embodiment of the present invention provides the following several optional implementations.

Manner 1: If the operation information to be executed includes performing signal enhancement processing on the ambient sound, a prompt sound used for reminding a user to notice the subsequently received ambient sound is determined according to the subsequently received ambient sound, and the prompt sound is used as the operated signal.

Manner 2: If the operation information to be executed includes performing signal enhancement processing on the ambient sound, a prompt sound used for reminding a user to notice the subsequently received ambient sound is determined according to the subsequently received ambient sound, and the prompt sound is used as the operated signal. In addition, if a power value of an ambient sound that is on a preset frequency band and that is included in the subsequently received ambient sound is greater than a power threshold, a phase-inverted sound wave is generated according to the subsequently received ambient sound, and the phase-inverted sound wave is used as the operated signal, where the preset frequency band is a preset frequency range of at least one noise.

Specifically, in Manner 1 and Manner 2, that is, after the scenario that matches the ambient sound is determined, a prompt sound is determined from a preset database that is used for storing the prompt sound, the prompt sound is mixed with an audio signal, the mixed signal is transmitted to human ears, and in this case, a person may hear the prompt sound and then stay alert. Therefore, a problem that the user is insensitive to a key sound in the ambient sound after wearing the headset is alleviated.

Further, in Manner 2, the preset frequency band is the preset frequency range of at least one noise. For example, the preset frequency band includes a frequency range of a sound of a motor of an automobile, a frequency range of a sound of a subway when traveling on a track, or the like. When the power value of the ambient sound that is on the preset frequency band and that is included in the subsequently received ambient sound is greater than the power threshold, it indicates that a noise is excessively high in a scenario in which the user stays. Therefore, the phase-inverted sound wave is generated according to the subsequently received ambient sound, and the phase-inverted sound wave is used as the operated signal. In this case, the processing device mixes the audio signal, the prompt sound, and the phase-inverted sound wave, to generate a mixed signal, and transmits the mixed signal to the human ears. It can be learned that, in Manner 2, performing signal enhancement processing on the ambient sound includes two aspects: On one hand, the prompt sound is output to enhance the ambient sound; and on the other hand, a noise reduction device in the processing device is started to generate the phase-inverted sound wave, so that noise reduction processing is performed on the ambient sound received by the ears. That is, in this manner, on one hand, the prompt sound is output, so that the person can hear the prompt sound and then stay alert. On the other hand, noise reduction is further performed on the ambient sound by using the generated phase-inverted sound wave. In this case, the prompt sound output by the processing device can be highlighted, that is, because noise reduction is performed on the ambient sound, the user can hear a clearer prompt sound, so that the user stays more alert. Further, in this case, the user may also hear the audio signal. It can be learned that, in this embodiment of the present invention, the user can still enjoy the audio signal when the prompt sound is sent to the user to make the user stay alert. Therefore, in this embodiment of the present invention, a more comfortable audio environment is provided for the user.

The prompt sound in this embodiment of the present invention may be a common alert sound, for example, some short audio that easily draws attention from the user, such as toot toot toot or di di di. Alternatively, the prompt sound may be a combined speech, for example, artificially voice broadcasted "please pay attention to cars nearby". Alternatively, the prompt sound may be a virtual background sound, for example, a virtual sound that is similar to a sound included in the ambient sound, such as a prestored honk, or a sound of a bicycle bell. Optionally, the user may self-define parameters such as type and volume of the prompt sound.

In Manner 1 and Manner 2, when the operation information to be executed includes performing signal enhancement processing on the ambient sound, at least the prompt sound is transmitted to the human ears. However, in some scenarios, the user expects to hear a part of the sound in the ambient sound. Based on this, this embodiment of the present invention provides the following several optional implementations.

Manner 3: If the operation information to be executed includes performing signal enhancement processing on the ambient sound, the subsequently received ambient sound is filtered by using a filter, to obtain a filtered ambient sound, and the filtered ambient sound is used as the operated signal.

Manner 4: If the operation information to be executed includes performing signal enhancement processing on the ambient sound, the subsequently received ambient sound is filtered by using a filter, to obtain a filtered ambient sound, and the filtered ambient sound is used as the operated signal. In addition, if a power value of an ambient sound that is on a preset frequency band and that is included in the subsequently received ambient sound is greater than a power threshold, a phase-inverted sound wave is generated according to the subsequently received ambient sound, and the phase-inverted sound wave is used as the operated signal, where the preset frequency band is a preset frequency range of at least one noise.

Manner 5: If the operation information to be executed includes performing signal enhancement processing on the ambient sound, the subsequently received ambient sound is filtered by using a filter, to obtain a filtered ambient sound, and the filtered ambient sound is used as the operated signal. In addition, if a power value of an ambient sound that is on a preset frequency band and that is included in the subsequently received ambient sound is greater than a power threshold, a phase-inverted sound wave is generated according to the subsequently received ambient sound, and the phase-inverted sound wave is used as the operated signal, where the preset frequency band is a preset frequency range of at least one noise. Further, before the performing filtering on the subsequently received ambient sound by using a filter, to obtain a filtered ambient sound, the method further includes: performing compensation on the preset frequency response of the filter according to a preset frequency response of the filter, and a frequency response of the phase-inverted sound wave used for noise reduction on the subsequently received ambient sound, to obtain a compensated frequency response; and performing, by using the filter, filtering on the ambient sound that is on the preset frequency band and that is of the ambient sound by using the compensated frequency response, to obtain the filtered ambient sound.

For example, the user expects to hear a sound of the wind, twittering, and chirping, but does not expect to hear a sound of a motor of an automobile on a road near a park. In addition, in this case, when the ambient sound enters the human ears through the headset, volume is weakened. Therefore, in this case, on one hand, volume of the sound of the wind, the twittering, and the chirping that are heard by the user is weakened; and on the other hand, the sound of a motor of an automobile can still be heard. Based on this scenario, in this embodiment of the present invention, in Manner 3, Manner 4, and Manner 5, filtering is performed on the subsequently received ambient sound by using the filter, to obtain the filtered ambient sound, so that a part that is of the ambient sound and that the user expects to hear is retained. For example, a parameter of the filter is set, after the sound of the wind, the twittering, the chirping, and the sound of a motor of an automobile pass through the filter, the filtered ambient sound includes only the sound of the wind, the twittering, and the chirping, but the sound of a motor of an automobile is filtered out. Then, the filtered signal is transmitted to the human ears, and is superposed on the sound that can be heard by the ears of the user, so that the part that is of the ambient sound and that the user expects to hear is highlighted, that is, sounds such as a sound of the wind, twittering, and chirping that are heard by the user are enhanced. In this way, when enjoying music, the user also hears a beautiful sound in the ambient sound.

Further, when the user wears a headset to listen to music in a park, the user actually hears a result of superposing a sound in the ambient sound that is transmitted to the ears through the headset on a sound played in the headset. Because a capability of a headset loudspeaker is limited, too loud volume is harmful to user's hearing. Therefore, if a noise existing in the ambient sound is relatively loud, in this case, playing the prompt sound or the filtered ambient sound to the user may be interfered with by the external ambient sound. Based on this problem, in Manner 4, preferably, the phase-inverted sound wave used for noise reduction is input if the power value of the ambient sound on the preset frequency band is greater than the power threshold. In this way, cancellation of a noise in the ambient sound is simultaneously implemented. For example, the sound of a motor of an automobile is an ambient sound on the preset frequency band, and in this case, the output phase-inverted sound wave may cancel the sound of a motor of an automobile that is heard by the user, so that noise reduction is achieved. In this way, because noise reduction is performed on the ambient sound, the volume of the ambient sound that can be heard by the user is lower. In this case, the filtered ambient sound output by the processing device is highlighted, that is, the filtered ambient sound heard by the user in this case is clearer, so that user experience is improved, and the user may further hear an audio signal in this case. It can be learned that, in this embodiment of the present invention, the user can still enjoy the audio signal when the filtered ambient sound is sent to the user. Therefore, in this embodiment of the present invention, a more comfortable audio environment is provided for the user.

Further, preferably, in Manner 5, when the operated signal includes both the filtered ambient sound and the phase-inverted sound wave, compensation is performed on the preset frequency response of the filter according to the preset frequency response of the filter, and the frequency response of the phase-inverted sound wave used for noise reduction on the subsequently received ambient sound. In this way, impact of the phase-inverted sound wave on the filtered ambient sound can be effectively reduced. On one hand, noise reduction is effectively performed on the noise in the ambient sound; and on the other hand, the sound that the user expects to hear in the ambient sound is enhanced.

In Manner 5, whether the power value of the ambient sound that is on the preset frequency band and that is included in the subsequently received ambient sound is greater than the power threshold is determined by using a formula (1):

$$S = \sum_{z=1}^{n} \|w(z) \cdot H_e(z)\|^2 \qquad \text{Formula (1)}$$

In the formula (1), $H_e(z)$ is a spectrum of a $z^{th}$ ambient sound on the preset frequency band of the subsequently received ambient sound; a value range of z is [1, n]; and n is a total quantity of ambient sounds that are on the preset frequency band and that are included in the ambient sound; and w(z) is a weighting function of the $z^{th}$ ambient sound on the preset frequency band of the subsequently received ambient sound; and a value of w(z) may be set according to a specific situation, for example, the spectrum of the $z^{th}$ ambient sound on the preset frequency band of the subsequently received ambient sound is from 50 Hz (Hz) to 2 KHz (KHz), and in this case, w(z)=1, and a value of a weighting function corresponding to an ambient sound of another spectrum is 0.

S is the power value of the ambient sound that is on the preset frequency band and that is included in the subsequently received ambient sound; and $S_{th}$ is the power threshold. If $S>S_{th}$, the phase-inverted sound wave is generated according to the subsequently received ambient sound. In addition, a preset frequency response Hr(z) of the filter is further obtained. The user may preset a frequency response of the filter according to a scenario and personal preferences, and perform compensation on the frequency response of the filter according to the frequency response of the phase-inverted sound wave used for noise reduction on the subsequently received ambient sound, to obtain the compensated frequency response, as shown in a formula (2):

$$H'r(z)=Hr(z)-Hanc(z) \qquad \text{Formula (2)}$$

In the formula (2), Hr(z) is the preset frequency response of the filter; Hanc(z) is a frequency response of the phase-inverted sound wave used for noise reduction on the subsequently received ambient sound; and H'r(z) is a compensated frequency response.

In specific implementation, the user not only needs to pay attention to the key sound in the ambient environment, but also needs to know a direction of a sound source, for example, whether a sound of a bicycle bell comes from the left or the right, so that the user can select a corresponding processing strategy. Based on this, optionally, if the operation information to be executed includes prompting a direction of the ambient sound, the processing device determines a phase difference and an amplitude difference between the subsequently received ambient sound that is received by a left sound pickup microphone of the headset and the subsequently received ambient sound that is received by a right sound pickup microphone of the headset. The processing device determines, according to the determined phase difference and amplitude difference, a left alarm prompt sound that needs to be output to an audio-left channel of the headset, and a right alarm prompt sound that needs to be output to an audio-right channel of the headset; and uses the left alarm prompt sound and the right alarm prompt sound as the operated signal.

A phase difference between the left alarm prompt sound and the right alarm prompt sound is the same as the determined phase difference between the subsequently received ambient sound that is received by the left sound pickup microphone and the subsequently received ambient sound that is received by the right sound pickup microphone of the headset; and an amplitude difference between the left alarm prompt sound and the right alarm prompt sound is the same as the determined amplitude difference between the subsequently received ambient sound that is received by the left sound pickup microphone and the subsequently received ambient sound that is received by the right sound pickup microphone of the headset.

In specific implementation, when a sound source is on the left, a sound heard by the left ear is earlier than a sound heard by the right ear, and an amplitude of the sound heard by the left ear is greater than that of the sound heard by the right ear, that is, intensity is higher. Because the headset is worn on the head, positions of earbuds of the headset are quite close to positions of the human ears. In this case, a sound source may be analyzed by using the ambient sound received by both a right earbud and a left earbud, and then, the phase difference and the amplitude difference between the left alarm prompt sound and the right alarm prompt sound that are input to the human ears is the same as the phase difference and the amplitude difference between the real ambient sound that enters a left ear and the real ambient sound that enters a right ear. Therefore, the user can determine a direction of the prompt sound according to the left alarm prompt sound and the right alarm prompt sound.

The prompt sound in this embodiment of the present invention may be a common alert sound, for example, some short audio that easily draws attention from the user, such as toot toot toot or di di di. Alternatively, the prompt sound may be a combined speech, for example, artificially voice broadcasted "please pay attention to cars nearby". Alternatively, the prompt sound may be a virtual background sound, for example, a virtual sound that is similar to a sound included in the ambient sound, such as a prestored honk, or a sound of a bicycle bell. Optionally, the user may self-define parameters such as type and volume of the prompt sound.

Optionally, the received ambient sound is filtered, so that some noises are filtered out, and then the ambient sound may be more accurately analyzed. For example, the sound other than the honk in the ambient sound is filtered out, and then the honk is analyzed.

A manner of calculating the phase difference and the amplitude difference between the subsequently received ambient sound that is received by the left sound pickup microphone of the headset and the subsequently received ambient sound that is received by the right sound pickup microphone of the headset is shown in a formula (3):

$$A = \sqrt{\frac{\sum_{i=1}^{I} \|S_r(i)\|^2}{\sum_{i=1}^{I} \|S_l(i)\|^2}} \qquad \text{Formula (3)}$$

$$\tau = \max \sum_{i=1}^{I} \|S_l(i) \cdot S_r(i+u)\|,$$

where $$x_1(i)=x(i)$$

$$x_r(i)=Ax(i+^{\tau})$$

In the formula (3), $S_1(i)$ is a subsequently received ambient sound that is received by the left sound pickup microphone of the headset in an $i^{th}$ measurement period; $S_r(i)$ is a subsequently received ambient sound that is received by the right sound pickup microphone of the headset in the $i^{th}$ measurement period; and a value range of i is [1, I], where I is a total quantity of measurement periods, and may be manually set;

A is an amplitude difference between the subsequently received ambient sound that is received by the left sound pickup microphone of the headset and the subsequently received ambient sound that is received by the right sound pickup microphone of the headset;

$S_r(i+u)$ is a signal that is obtained by delaying the subsequently received ambient sound that is received by the right sound pickup microphone of the headset in an $i^{th}$ measurement period for duration u;

u is a time difference between the subsequently received ambient sound that is received by the left sound pickup microphone and the subsequently received ambient sound that is received by the right sound pickup microphone, that is, u is scanned, and when u is equal to the time difference between the subsequently received ambient sound that is received by the left sound pickup microphone and the subsequently received ambient sound that is received by the right sound pickup microphone, a correlation value between the subsequently received ambient sound that is received by the left sound pickup microphone and the subsequently received ambient sound that is received by the right sound pickup microphone is the largest; a range of U is [−W, W], and W is a preset largest time difference supported by the processing device; and W may be a measurement period;

τ is a phase difference between the subsequently received ambient sound that is received by the left sound pickup microphone of the headset and the subsequently received ambient sound that is received by the right sound pickup microphone of the headset;

x(i) is an alarm prompt sound generated by a system;

$x(i+^{\tau})$ is a signal that is obtained by delaying the alarm prompt sound x(i) generated by the system for duration τ; and $x_1(i)$ is a left alarm prompt sound that needs to be output to an audio-left channel of the headset; and $x_r(i)$ is a left alarm prompt sound that needs to be output to an audio-right channel of the headset.

Optionally, the operation information to be executed includes performing speech recognition processing on the ambient sound; and the performing an operation according to the operation information to be executed and a subsequently received ambient sound, and obtaining an operated signal specifically includes any one or any combination of the following items:

performing speech recognition on the ambient sound, determining a virtual prompt sound corresponding to a recognized speech according to the recognized speech, and using the virtual prompt sound as the operated signal;

performing speech recognition on the subsequently received ambient sound, increasing an amplitude of the recognized speech to obtain an amplitude-increased speech, and using the amplitude-increased speech as the operated signal; or performing speech recognition on the subsequently received ambient sound, when it is determined that a language form of a recognized speech is inconsistent with a preset language form, translating the recognized speech into a speech corresponding to the preset language form, and using the translated speech as the operated signal.

Optionally, in this embodiment of the present invention, the operation information to be executed includes performing speech recognition processing on the ambient sound, the determined operated signal may be mixed with an audio signal played by the user equipment, to obtain a mixed signal, and the mixed signal is output to the headset. In this way, the user not only can enjoy the audio signal while it is ensured that the audio signal is not interrupted, and but also can hear a recognized virtual prompt sound, an amplitude-increased speech, or a translated speech. In another implementation, when the operation information to be executed includes performing speech recognition processing on the ambient sound, playing of the audio signal may be interrupted, and the determined operated signal is independently output. In this way, the user may more clearly hear a recognized virtual prompt sound, an amplitude-increased speech, or a translated speech.

Specifically, a virtual prompt sound corresponding to the recognized speech is determined according to the recognized speech. Specifically, the virtual prompt sound may be a recognized speech that is artificially voice broadcasted, for example, if the recognized speech is "have you had your dinner yet?", the virtual prompt sound may be artificially broadcasted "have you had your dinner yet?". In this way, speech information in the ambient sound may be more clearly fed back to the user.

An amplitude of the recognized speech is increased to obtain an amplitude-increased speech, and the amplitude-increased speech is used as the operated signal. In this way, when a noise in the ambient sound is extremely high, or when the user has hearing impairment, volume of a voice of other people may be effectively increased, thereby achieving an effect of a hearing aid for the user.

When it is determined that a language form of the recognized speech is inconsistent with a preset language form, the recognized speech is translated into a speech corresponding to the preset language form, and the translated speech is used as the operated signal. Optionally, translation of the recognized language may be implemented by using translation software, so as to provide various services for the user. Optionally, after the speech is recognized, the speech may further be recorded and saved.

Optionally, the recognized human language is converted into text information, and the converted text information is displayed on the user equipment; or the recognized human language is converted into text information, when it is determined that a language form of the converted text information is inconsistent with the preset language form, the converted text information is translated into text information corresponding to the preset language form, and the text information corresponding to the preset language form is displayed on the user equipment. Optionally, after recognizing the speech, the processing device may further remind, by means of ringing or vibration on the user equipment, the user to notice the recognized speech.

For example, the recognized human speech is displayed on a mobile phone screen of the user. In this way, the user may more clearly determine speech content in the ambient sound, and various services may be better performed for people who have hearing impairment.

Optionally, the processing device receives a sound that is obtained by mixing a mixed signal that is received by a left feedback microphone and a right feedback microphone with the ambient sound heard by the human ears; analyzes the sound that is obtained by mixing the received mixed signal with the ambient sound heard by the human ears; adjusts the operated signal according to the obtained analysis result; and mixes an adjusted operation signal with the audio signal played by the user equipment, to obtain a corrected mixed signal, and transmits the corrected mixed signal to the headset.

For example, the operated signal is the phase-inverted sound wave, the processing device receives a sound that is obtained by mixing a mixed signal that is received by a left feedback microphone and a right feedback microphone with the ambient sound heard by the human ears, and the phase-inverted sound wave in the mixed signal and a noise in the ambient sound heard by the human ears are canceled. In this case, there are few noises in the sound that is obtained by mixing the mixed signal with the ambient sound heard by the human ears. The sound that is obtained by mixing the mixed signal with the ambient sound heard by the human ears is analyzed, and the operated signal is adjusted according to an analysis result. For example, a phase of the phase-inverted sound wave is adjusted, so that cancellation is better performed on the ambient sound by using a phase-inverted sound wave in a corrected mixed signal, that is, noise reduction is better performed on the ambient sound by using the phase-inverted sound wave in the corrected mixed signal. In this way, the corrected mixed signal is transmitted to the headset, so that an effect of noise reduction on the ambient sound heard by the human ears is better, and the user better enjoys music or other audio in the audio signal. Therefore, user experience is further improved.

It can be learned from the foregoing content that, in this embodiment of the present invention, the time-frequency spectrum of the ambient sound in the preset duration is determined according to the received ambient sound in the preset duration; the matching scenario is determined from the time-frequency spectrum of the at least one preset scenario according to the time-frequency spectrum of the ambient sound in the preset duration, where the time-frequency spectrum of the matching scenario matches the time-frequency spectrum of the ambient sound in the preset duration; the operation information corresponding to the matching scenario is determined as the operation information to be executed; the operation is performed according to the operation information to be executed and the subsequently received ambient sound, and the operated signal is determined; and the operated signal is mixed with the audio signal played by the user equipment, to obtain the mixed signal, and the mixed signal is transmitted to the headset. Because some sporadic sounds may exist, it is inaccurate to analyze a scenario in which the user stays only according to a sound included in the ambient sound. Based on this, in this embodiment of the present invention, analysis is performed according to the time-frequency spectrum of the ambient sound in the preset duration, so that accuracy of recognition of the ambient sound is further improved. Then, when the matching scenario is determined from the at least one preset scenario according to the time-frequency spectrum of the ambient sound in the preset duration, a matching scenario that is closest to a real scenario in which the user stays can be determined. Then, when the operation is performed according to the operation information corresponding to the matching scenario, that is, the operation is performed according to the real scenario in which the user stays, so that a more accurate operation is performed on the ambient sound according to the scenario in which the user stays, and a more accurate prompt and a better service are provided for the user.

Figure 3:
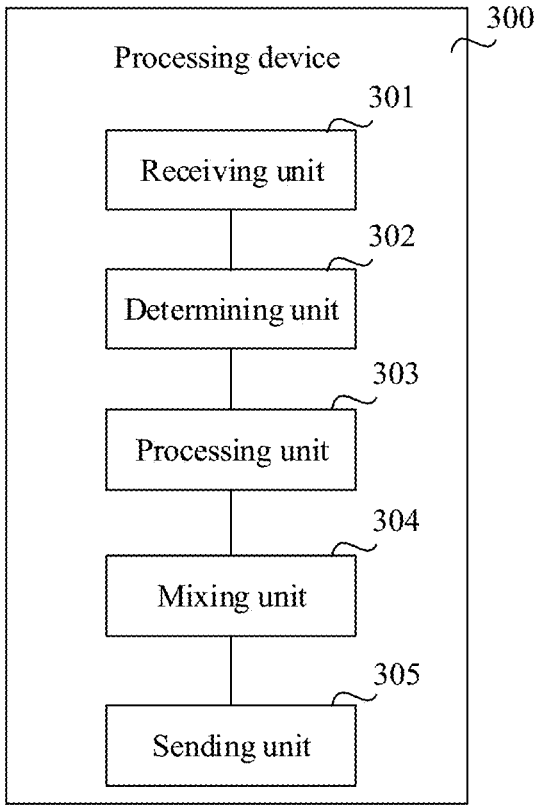
FIG. 3 is a schematic structural diagram of a processing device for processing an ambient sound according to an embodiment of the present invention.

FIG. 3 shows a schematic structural diagram of an example of a processing device for processing an ambient sound according to an embodiment of the present invention.

Based on a same concept, this embodiment of the present invention provides the processing device 300 for processing the ambient sound, to perform the embodiment of the ambient sound processing method. As shown in FIG. 3, the processing device 300 includes a receiving unit 301, a determining unit 302, a processing unit 303, a mixing unit 304, and a sending unit 305.

The receiving unit is configured to receive an ambient sound.

The determining unit is configured to: determine a time-frequency spectrum of the ambient sound in preset duration according to the received ambient sound in the preset duration; determine a matching scenario from a time-frequency spectrum of at least one preset scenario according to the time-frequency spectrum of the ambient sound in the preset duration; and determine operation information corresponding to the matching scenario as operation information to be executed, where a time-frequency spectrum of the matching scenario matches the time-frequency spectrum of the ambient sound in the preset duration.

The processing unit is configured to perform an operation according to the operation information to be executed and a subsequently received ambient sound, and determine an operated signal.

The mixing unit is configured to mix the operated signal with an audio signal played by user equipment, to obtain a mixed signal.

The sending unit is configured to transmit the mixed signal to a headset.

Optionally, the processing device may be located in the headset, or may be located on a user equipment side.

Optionally, the determining unit is specifically configured to:

perform normalized cross correlation on the time-frequency spectrum of the ambient sound in the preset duration and a time-frequency spectrum of each scenario in the at least one preset scenario, to obtain at least one cross correlation value;

if a largest cross correlation value in the at least one cross correlation value is greater than a cross correlation threshold, determine a scenario corresponding to the largest cross correlation value as an alternative scenario, where at least one characteristic spectrum is preset for the alternative scenario, and the characteristic spectrum of the alternative scenario includes all or a part of a time-frequency spectrum of the alternative scenario;

determine energy of each characteristic spectrum in the at least one characteristic spectrum from the time-frequency spectrum of the ambient sound in the preset duration;

determine average energy of all characteristic spectrums of the ambient sound in the preset duration according to energy of each characteristic spectrum of the ambient sound in the preset duration; and when it is determined that the average energy is greater than an energy threshold, determine the alternative scenario as the matching scenario.

The characteristic spectrum includes all or some of the spectrums included in both the time-frequency spectrum of the ambient sound in the preset duration and the time-frequency spectrum corresponding to the alternative scenario.

Optionally, the operation information to be executed includes any one or any combination of the following items:

performing signal enhancement processing on the ambient sound, prompting a direction of the ambient sound, performing speech recognition processing on the ambient sound, or performing noise reduction processing on the ambient sound.

Optionally, the operation information to be executed includes performing signal enhancement processing on the ambient sound; and the processing unit is specifically configured to perform any one of the following items:

Manner 1: If the operation information to be executed includes performing signal enhancement processing on the ambient sound, a prompt sound used for reminding a user to notice the subsequently received ambient sound is determined according to the subsequently received ambient sound, and the prompt sound is used as the operated signal.

Manner 2: If the operation information to be executed includes performing signal enhancement processing on the ambient sound, a prompt sound used for reminding a user to notice the subsequently received ambient sound is determined according to the subsequently received ambient sound, and the prompt sound is used as the operated signal. In addition, if a power value of an ambient sound that is on a preset frequency band and that is included in the subsequently received ambient sound is greater than a power threshold, a phase-inverted sound wave is generated according to the subsequently received ambient sound, and the phase-inverted sound wave is used as the operated signal, where the preset frequency band is a preset frequency range of at least one noise.

Manner 3: If the operation information to be executed includes performing signal enhancement processing on the ambient sound, the subsequently received ambient sound is filtered by using a filter, to obtain a filtered ambient sound, and the filtered ambient sound is used as the operated signal.

Manner 4: If the operation information to be executed includes performing signal enhancement processing on the ambient sound, the subsequently received ambient sound is filtered by using a filter, to obtain a filtered ambient sound, and the filtered ambient sound is used as the operated signal. In addition, if a power value of an ambient sound that is on a preset frequency band and that is included in the subsequently received ambient sound is greater than a power threshold, a phase-inverted sound wave is generated according to the subsequently received ambient sound, and the phase-inverted sound wave is used as the operated signal, where the preset frequency band is a preset frequency range of at least one noise.

Manner 5: If the operation information to be executed includes performing signal enhancement processing on the ambient sound, the subsequently received ambient sound is filtered by using a filter, to obtain a filtered ambient sound, and the filtered ambient sound is used as the operated signal. In addition, if a power value of an ambient sound that is on a preset frequency band and that is included in the subsequently received ambient sound is greater than a power threshold, a phase-inverted sound wave is generated according to the subsequently received ambient sound, and the phase-inverted sound wave is used as the operated signal, where the preset frequency band is a preset frequency range of at least one noise. Further, before the performing filtering on the subsequently received ambient sound by using a filter, to obtain a filtered ambient sound, the method further includes: performing compensation on the preset frequency response of the filter according to a preset frequency response of the filter, and a frequency response of the phase-inverted sound wave used for noise reduction on the subsequently received ambient sound, to obtain a compensated frequency response; and performing, by using the filter, filtering on the ambient sound that is on the preset frequency band and that is of the ambient sound by using the compensated frequency response, to obtain the filtered ambient sound.

Optionally, the operation information to be executed includes prompting a direction of the ambient sound; and the processing unit is specifically configured to:

determine a phase difference and an amplitude difference between the subsequently received ambient sound that is received by a left sound pickup microphone of the headset and the subsequently received ambient sound that is received by a right sound pickup microphone of the headset; and determine, according to the determined phase difference and amplitude difference, a left alarm prompt sound that needs to be output to an audio-left channel of the headset, and a right alarm prompt sound that needs to be output to an audio-right channel of the headset; and use the left alarm prompt sound and the right alarm prompt sound as the operated signal, where a phase difference between the left alarm prompt sound and the right alarm prompt sound is the same as the determined phase difference between the subsequently received ambient sound that is received by the left sound pickup microphone and the subsequently received ambient sound that is received by the right sound pickup microphone of the headset; and an amplitude difference between the left alarm prompt sound and the right alarm prompt sound is the same as the determined amplitude difference between the subsequently received ambient sound that is received by the left sound pickup microphone and the subsequently received ambient sound that is received by the right sound pickup microphone of the headset.

Optionally, the operation information to be executed includes performing speech recognition processing on the ambient sound; and the processing unit is specifically configured to perform any one or any combination of the following items:

performing speech recognition on the ambient sound, determining a virtual prompt sound corresponding to a recognized speech according to the recognized speech, and using the virtual prompt sound as the operated signal;

performing speech recognition on the subsequently received ambient sound, increasing an amplitude of the recognized speech to obtain an amplitude-increased speech, and using the amplitude-increased speech as the operated signal; or performing speech recognition on the subsequently received ambient sound, when it is determined that a language form of a recognized speech is inconsistent with a preset language form, translating the recognized speech into a speech corresponding to the preset language form, and using the translated speech as the operated signal.

Optionally, after the performing an operation according to the operation information to be executed and a subsequently received ambient sound, and obtaining an operated signal, the processing unit is further configured to:

convert the recognized human language into text information, and display the converted text information on the user equipment; or convert the recognized human language into text information, when it is determined that a language form of the converted text information is inconsistent with the preset language form, translate the converted text information into text information corresponding to the preset language form, and display the text information corresponding to the preset language form on the user equipment.

Optionally, the operation information to be executed includes performing noise reduction processing on the ambient sound; and the processing unit is specifically configured to:

generate a phase-inverted sound wave according to the subsequently received ambient sound, and use the phase-inverted sound wave as the operated signal.

Optionally, the processing unit is further configured to:

determine that the headset is on the head of the user.

It can be learned from the foregoing content that, in this embodiment of the present invention, the time-frequency spectrum of the ambient sound in the preset duration is determined according to the received ambient sound in the preset duration; the matching scenario is determined from the time-frequency spectrum of the at least one preset scenario according to the time-frequency spectrum of the ambient sound in the preset duration, where the time-frequency spectrum of the matching scenario matches the time-frequency spectrum of the ambient sound in the preset duration; the operation information corresponding to the matching scenario is determined as the operation information to be executed; the operation is performed according to the operation information to be executed and the subsequently received ambient sound, and the operated signal is determined; and the operated signal is mixed with the audio signal played by the user equipment, to obtain the mixed signal, and the mixed signal is transmitted to the headset. Because some sporadic sounds may exist, it is inaccurate to analyze a scenario in which the user stays only according to a sound included in the ambient sound. Based on this, in this embodiment of the present invention, analysis is performed according to the time-frequency spectrum of the ambient sound in the preset duration, so that accuracy of recognition of the ambient sound is further improved. Then, when the matching scenario is determined from the at least one preset scenario according to the time-frequency spectrum of the ambient sound in the preset duration, a matching scenario that is closest to a real scenario in which the user stays can be determined. Then, when the operation is performed according to the operation information corresponding to the matching scenario, that is, the operation is performed according to the real scenario in which the user stays, so that a more accurate operation is performed on the ambient sound according to the scenario in which the user stays, and a more accurate prompt and a better service are provided for the user.

FIG. 4 shows a schematic structural diagram of an example of another processing device for processing an ambient sound according to an embodiment of the present invention.

Based on a same concept, this embodiment of the present invention provides the processing device 400 for processing the ambient sound, to perform the method procedure for processing the ambient sound. As shown in FIG. 4, the processing device 400 includes a processor 401, a memory 402, a receiver 403, and a transmitter 404.

The processor reads a program stored in the memory and performs the following procedure:

A time-frequency spectrum of an ambient sound in preset duration is determined according to the ambient sound in the preset duration that is received by using the receiver; a matching scenario is determined from a time-frequency spectrum of at least one preset scenario according to the time-frequency spectrum of the ambient sound in the preset duration, where a time-frequency spectrum of the matching scenario matches the time-frequency spectrum of the ambient sound in the preset duration; operation information corresponding to the matching scenario is determined as operation information to be executed; an operation is performed according to the operation information to be executed and a subsequently received ambient sound, and an operated signal is determined; and the operated signal is mixed with an audio signal played by user equipment, to obtain a mixed signal, and the mixed signal is transmitted to a headset. Optionally, the processor may be located in the headset, or may be located on a user equipment side.

The receiver is configured to receive the ambient sound under control of the processor. Optionally, the receiver is connected to a left sound pickup microphone of the headset and a right sound pickup microphone of the headset. The receiver receives an ambient sound that is received by the left sound pickup microphone of the headset and the right sound pickup microphone of the headset. In another implementation, the receiver may be connected to a microphone on the user equipment, and in this case, the receiver may receive an ambient sound received by the microphone on the user equipment.

The transmitter is configured to transmit the mixed signal to the headset under the control of the processor. Specifically, the transmitter is connected to an audio-left channel and an audio-right channel of the headset, and the transmitter transmits the mixed signal to the audio-left channel and the audio-right channel of the headset. Further, the audio-left channel is connected to a left loudspeaker, and the audio-right channel is connected to a right loudspeaker. In this case, the mixed signal that is output by the transmitter to the audio-left channel of the headset enters a human ear through the left loudspeaker, and the mixed signal that is output by the transmitter to the audio-right channel of the headset enters a human ear through the right loudspeaker.

The memory is configured to: store the time-frequency spectrum of the at least one preset scenario, and the operation information corresponding to the matching scenario, and store the program.

Optionally, the processor is specifically configured to perform the embodiment of the ambient sound processing method.

A bus architecture may include any quantity of interconnected buses and bridges. Specifically, the bus architecture links various circuits of one or more processors represented by the processor and various circuits of one or more memories represented by the memory. The bus architecture may further link various other circuits such as a peripheral device, a voltage regulator, and a power management circuit. This is well known in the art, and therefore, this specification provides no further description. A bus interface provides an interface. The receiver and the transmitter are used to implement communication between a transmission medium and other devices. The processor is responsible for bus architecture management and general processing, and the memory may store data used when the processor performs an operation.

It can be learned from the foregoing content that, in this embodiment of the present invention, the time-frequency spectrum of the ambient sound in the preset duration is determined according to the received ambient sound in the preset duration; the matching scenario is determined from the time-frequency spectrum of the at least one preset scenario according to the time-frequency spectrum of the ambient sound in the preset duration, where the time-frequency spectrum of the matching scenario matches the time-frequency spectrum of the ambient sound in the preset duration; the operation information corresponding to the matching scenario is determined as the operation information to be executed; the operation is performed according to the operation information to be executed and the subsequently received ambient sound, and the operated signal is determined; and the operated signal is mixed with the audio signal played by the user equipment, to obtain the mixed signal, and the mixed signal is transmitted to the headset. Because some sporadic sounds may exist, it is inaccurate to analyze a scenario in which the user stays only according to a sound included in the ambient sound. Based on this, in this embodiment of the present invention, analysis is performed according to the time-frequency spectrum of the ambient sound in the preset duration, so that accuracy of recognition of the ambient sound is further improved. Then, when the matching scenario is determined from the at least one preset scenario according to the time-frequency spectrum of the ambient sound in the preset duration, a matching scenario that is closest to a real scenario in which the user stays can be determined. Then, when the operation is performed according to the operation information corresponding to the matching scenario, that is, the operation is performed according to the real scenario in which the user stays, so that a more accurate operation is performed on the ambient sound according to the scenario in which the user stays, and a more accurate prompt and a better service are provided for the user.

Persons skilled in the art should understand that the embodiments of the present invention may be provided as a method, or a computer program product. Therefore, the present invention may use a form of hardware only embodiments, software only embodiments, or embodiments with a combination of software and hardware. In addition, the present invention may use a form of a computer program product that is implemented on one or more computer-usable storage media (including but not limited to a disk memory, a CD-ROM, an optical memory, and the like) that include computer-usable program code.

The present invention is described with reference to the flowcharts and/or block diagrams of the method, the device (system), and the computer program product according to the embodiments of the present invention. It should be understood that computer program instructions may be used to implement each process and/or each block in the flowcharts and/or the block diagrams and a combination of a process and/or a block in the flowcharts and/or the block diagrams. These computer program instructions may be provided for a general-purpose computer, a dedicated computer, an embedded processor, or a processor of any other programmable data processing device to generate a machine, so that the instructions executed by a computer or a processor of any other programmable data processing device generate a device for implementing a specific function in one or more processes in the flowcharts and/or in one or more blocks in the block diagrams.

These computer program instructions may also be stored in a computer readable memory that can instruct the computer or any other programmable data processing device to work in a specific manner, so that the instructions stored in the computer readable memory generate an artifact that includes an instruction device. The instruction device implements a specific function in one or more processes in the flowcharts and/or in one or more blocks in the block diagrams.

These computer program instructions may be loaded onto a computer or another programmable data processing device, so that a series of operations and steps are performed on the computer or the another programmable device, thereby generating computer-implemented processing. Therefore, the instructions executed on the computer or the another programmable device provide steps for implementing a specific function in one or more processes in the flowcharts and/or in one or more blocks in the block diagrams.

Although some embodiments of the present invention have been described, persons skilled in the art can make changes and modifications to these embodiments once they learn the basic inventive concept. Therefore, the following claims are intended to be construed as to cover the embodiments and all changes and modifications falling within the scope of the present invention.

Obviously, persons skilled in the art can make various modifications and variations to the present invention without departing from the spirit and scope of the present invention. The present invention is intended to cover these modifications and variations provided that they fall within the scope of protection defined by the following claims and their equivalent technologies.

What is claimed is:

1. An ambient sound processing method, comprising:

determining a time-frequency spectrum of an ambient sound in preset duration;

determining a matching scenario from at least one preset scenario according to the time-frequency spectrum of the ambient sound in the preset duration, wherein a time-frequency spectrum of the matching scenario matches the time-frequency spectrum of the ambient sound in the preset duration;

determining operation information corresponding to the determined matching scenario as an operation information to be executed;

performing an operation according to the operation information to be executed and a subsequently received ambient sound, and obtaining an operated signal;

mixing the operated signal with an audio signal played by user equipment to obtain a mixed signal; and transmitting the mixed signal to a headset, wherein the operation information to be executed comprises prompting a direction of the ambient sound; and the performing an operation according to the operation information to be executed and a subsequently received ambient sound, and obtaining an operated signal comprises:

determining a phase difference and an amplitude difference between the subsequently received ambient sound that is received by a left sound pickup microphone of the headset and the subsequently received ambient sound that is received by a right sound pickup microphone of the headset; and determining, according to the determined phase difference and amplitude difference, a left alarm prompt sound to be output to an audio-left channel of the headset and a right alarm prompt sound to be output to an audio-right channel of the headset; and using the left alarm prompt sound and the right alarm prompt sound as the operated signal, wherein a phase difference between the left alarm prompt sound and the right alarm prompt sound is the same as the determined phase difference between the subsequently received ambient sound that is received by the left sound pickup microphone and the subsequently received ambient sound that is received by the right sound pickup microphone of the headset; and an amplitude difference between the left alarm prompt sound and the right alarm prompt sound is the same as the determined amplitude difference between the subsequently received ambient sound that is received by the left sound pickup microphone and the subsequently received ambient sound that is received by the right sound pickup microphone of the headset.

2. The method according to claim 1, wherein the determining a matching scenario from at least one preset scenario according to the time-frequency spectrum of the ambient sound in the preset duration comprises:

performing normalized cross correlation on the time-frequency spectrum of the ambient sound in the preset duration and a time-frequency spectrum of each scenario in the at least one preset scenario to obtain at least one cross correlation value;

in response to determining that a largest cross correlation value in the at least one cross correlation value is greater than a cross correlation threshold, determining a scenario corresponding to the largest cross correlation value as an alternative scenario, wherein at least one characteristic spectrum is preset for the alternative scenario, and wherein the characteristic spectrum of the alternative scenario comprises all or a part of a time-frequency spectrum of the alternative scenario;

determining energy of each characteristic spectrum in the at least one characteristic spectrum from the time-frequency spectrum of the ambient sound in the preset duration;

determining average energy of all characteristic spectrums of the ambient sound in the preset duration according to energy of each characteristic spectrum of the ambient sound in the preset duration; and when the average energy is greater than an energy threshold, determining the alternative scenario as the matching scenario.

3. The method according to claim 1, wherein the operation information to be executed comprises performing signal enhancement processing on the ambient sound; and the performing an operation according to the operation information to be executed and a subsequently received ambient sound, and obtaining an operated signal comprises:

determining, according to the subsequently received ambient sound, a prompt sound used for reminding a user to notice the subsequently received ambient sound, and using the prompt sound as the operated signal; and in response to determining that a power value of an ambient sound that is on a preset frequency band and that is comprised in the subsequently received ambient sound is greater than a power threshold, generating, according to the subsequently received ambient sound, a phase-inverted sound wave used for noise reduction on the subsequently received ambient sound, and using the phase-inverted sound wave as the operated signal, wherein the preset frequency band is a preset frequency range of at least one noise.

4. The method according to claim 1, wherein the operation information to be executed comprises performing signal enhancement processing on the ambient sound; and the performing an operation according to the operation information to be executed and a subsequently received ambient sound, and obtaining an operated signal comprises:

performing filtering on the subsequently received ambient sound by using a filter to obtain a filtered ambient sound, and using the filtered ambient sound as the operated signal.

5. The method according to claim 4, wherein after the performing an operation according to the operation information to be executed and a subsequently received ambient sound, and obtaining an operated signal, the method further comprises:

in response to determining that a power value of an ambient sound that is on a preset frequency band and that is comprised in the subsequently received ambient sound is greater than a power threshold, generating, according to the subsequently received ambient sound, a phase-inverted sound wave used for noise reduction on the subsequently received ambient sound, and using the phase-inverted sound wave as the operated signal, wherein the preset frequency band is a preset frequency range of at least one noise.

6. The method according to claim 5, wherein before the performing filtering on the subsequently received ambient sound by using a filter to obtain a filtered ambient sound, the method further comprises:

performing, according to a preset frequency response of the filter and a frequency response of the phase-inverted sound wave used for noise reduction on the subsequently received ambient sound, compensation on the preset frequency response of the filter to obtain a compensated frequency response; and performing, by using the filter, filtering on the ambient sound that is on the preset frequency band and that is of the ambient sound by using the compensated frequency response to obtain the filtered ambient sound.

7. The method according to claim 1, wherein the operation information to be executed comprises performing speech recognition processing on the ambient sound; and the performing an operation according to the operation information to be executed and a subsequently received ambient sound, and obtaining an operated signal comprises any one or any combination of the following items:

performing speech recognition on the ambient sound, determining a virtual prompt sound corresponding to a recognized speech according to the recognized speech, and using the virtual prompt sound as the operated signal;

performing speech recognition on the subsequently received ambient sound, increasing an amplitude of the recognized speech to obtain an amplitude-increased speech, and using the amplitude-increased speech as the operated signal; or performing speech recognition on the subsequently received ambient sound, when a language form of a recognized speech is inconsistent with a preset language form, translating the recognized speech into a speech corresponding to the preset language form, and using the translated speech as the operated signal.

8. The method according to claim 7, wherein after the performing an operation according to the operation information to be executed and a subsequently received ambient sound, and obtaining an operated signal, the method further comprises:

converting the recognized speech into text information, and displaying the text information on the user equipment; or converting the recognized speech into text information, translating the converted text information into text information corresponding to the preset language form when a language form of the converted text information is inconsistent with the preset language form, and displaying the text information corresponding to the preset language form on the user equipment.

9. The method according to claim 1, wherein the operation information to be executed comprises performing noise reduction processing on the ambient sound; and the performing an operation according to the operation information to be executed and a subsequently received ambient sound, and obtaining an operated signal comprises:

generating, according to the subsequently received ambient sound, a phase-inverted sound wave used for noise reduction on the subsequently received ambient sound, and using the phase-inverted sound wave as the operated signal.

10. A processing device for processing an ambient sound, comprising:

a receiver, the receiver configured to receive an ambient sound;

a transmitter; and at least one processor, the at least one processor configured to:

determine, according to the ambient sound in preset duration that is received by using the receiver, a time-frequency spectrum of the ambient sound in the preset duration;

determine a matching scenario from at least one preset scenario according to the time-frequency spectrum of the ambient sound in the preset duration; and determine operation information corresponding to the determined matching scenario as an operation information to be executed;

perform an operation according to the operation information to be executed and a subsequently received ambient sound, and determine an operated signal;

mix the operated signal with an audio signal played by user equipment, to obtain a mixed signal; and transmit the mixed signal to a headset by using the transmitter, wherein a time-frequency spectrum of the matching scenario matches the time-frequency spectrum of the ambient sound in the preset duration;

the transmitter configured to transmit the mixed signal to the headset under control of the at least one processor; and a memory, the memory configured to store the time-frequency spectrum of the at least one preset scenario and the operation information corresponding to the matching scenario, wherein the operation information to be executed comprises prompting a direction of the ambient sound; and the at least one processor is configured to:

determine a phase difference and an amplitude difference between the subsequently received ambient sound that is received by a left sound pickup microphone of the headset and the subsequently received ambient sound that is received by a right sound pickup microphone of the headset; and determine, according to the determined phase difference and amplitude difference, a left alarm prompt sound to be output to an audio-left channel of the headset, and a right alarm prompt sound to be output to an audio-right channel of the headset; and use the left alarm prompt sound and the right alarm prompt sound as the operated signal, wherein a phase difference between the left alarm prompt sound and the right alarm prompt sound is the same as the determined phase difference between the subsequently received ambient sound that is received by the left sound pickup microphone and the subsequently received ambient sound that is received by the right sound pickup microphone of the headset; and an amplitude difference between the left alarm prompt sound and the right alarm prompt sound is the same as the determined amplitude difference between the subsequently received ambient sound that is received by the left sound pickup microphone and the subsequently received ambient sound that is received by the right sound pickup microphone of the headset.

11. The device according to claim 10, wherein the at least one processor is configured to:

perform normalized cross correlation on the time-frequency spectrum of the ambient sound in the preset duration and a time-frequency spectrum of each scenario in the at least one preset scenario to obtain at least one cross correlation value;

in response to determining that a largest cross correlation value in the at least one cross correlation value is greater than a cross correlation threshold, determine a scenario corresponding to the largest cross correlation value as an alternative scenario, wherein at least one characteristic spectrum is preset for the alternative scenario, and wherein the characteristic spectrum of the alternative scenario comprises all or a part of a time-frequency spectrum of the alternative scenario;

determine energy of each characteristic spectrum in the at least one characteristic spectrum from the time-frequency spectrum of the ambient sound in the preset duration;

determine average energy of all characteristic spectrums of the ambient sound in the preset duration according to energy of each characteristic spectrum of the ambient sound in the preset duration; and when the average energy is greater than an energy threshold, determine the alternative scenario as the matching scenario, wherein the characteristic spectrum comprises all or some of the spectrums comprised in both the time-frequency spectrum of the ambient sound in the preset duration and the time-frequency spectrum corresponding to the alternative scenario.

12. The device according to claim 10, wherein the operation information to be executed comprises performing signal enhancement processing on the ambient sound; and the at least one processor is configured to:

determine, according to the subsequently received ambient sound, a prompt sound used for reminding a user to notice the subsequently received ambient sound, and use the prompt sound as the operated signal; and in response to determining that a power value of an ambient sound that is on a preset frequency band and that is comprised in the subsequently received ambient sound is greater than a power threshold, generate, according to the subsequently received ambient sound, a phase-inverted sound wave used for noise reduction on the subsequently received ambient sound, and use the phase-inverted sound wave as the operated signal, wherein the preset frequency band is a preset frequency range of at least one noise.

13. The device according to claim 10, wherein the operation information to be executed comprises performing signal enhancement processing on the ambient sound; and the at least one processor is configured to:

perform filtering on the subsequently received ambient sound by using a filter to obtain a filtered ambient sound, and use the filtered ambient sound as the operated signal.

14. The device according to claim 13, wherein the at least one processor is configured to:

after the performing an operation according to the operation information to be executed and a subsequently received ambient sound, and obtaining an operated signal, in response to determining that a power value of an ambient sound that is on a preset frequency band and that is comprised in the subsequently received ambient sound is greater than a power threshold, generate, according to the subsequently received ambient sound, a phase-inverted sound wave used for noise reduction on the subsequently received ambient sound, and use the phase-inverted sound wave as the operated signal, wherein the preset frequency band is a preset frequency range of at least one noise.

15. The device according to claim 14, wherein the at least one processor is configured to:

before the performing filtering on the subsequently received ambient sound by using a filter to obtain a filtered ambient sound, perform, according to a preset frequency response of the filter and a frequency response of the phase-inverted sound wave used for noise reduction on the subsequently received ambient sound, compensation on the preset frequency response of the filter to obtain a compensated frequency response; and perform, by using the filter, filtering on the ambient sound that is on the preset frequency band and that is of the ambient sound by using the compensated frequency response to obtain the filtered ambient sound.

16. The device according to claim 10, wherein the operation information to be executed comprises performing speech recognition processing on the ambient sound; and the at least one processor is configured to perform any one or any combination of the following items:

performing speech recognition on the ambient sound, determining a virtual prompt sound corresponding to the recognized speech according to the recognized speech, and using the virtual prompt sound as the operated signal;

performing speech recognition on the subsequently received ambient sound, increasing an amplitude of the recognized speech to obtain an amplitude-increased speech, and using the amplitude-increased speech as the operated signal; or performing speech recognition on the subsequently received ambient sound, when a language form of a recognized speech is inconsistent with a preset language form, translating the recognized speech into a speech corresponding to the preset language form, and using the translated speech as the operated signal.

17. The device according to claim 16, wherein after the performing an operation according to the operation information to be executed and a subsequently received ambient sound, and obtaining an operated signal, the at least one processor is further configured to:

convert the recognized speech into text information, and display the text information on the user equipment; or convert the recognized speech into text information, translate the converted text information into text information corresponding to the preset language form when a language form of the converted text information is inconsistent with the preset language form, and display the text information corresponding to the preset language form on the user equipment.

18. The device according to claim 10, wherein the operation information to be executed comprises performing noise reduction processing on the ambient sound; and the at least one processor is configured to:

generate, according to the subsequently received ambient sound, a phase-inverted sound wave used for noise reduction on the subsequently received ambient sound, and use the phase-inverted sound wave as the operated signal.

* * * * *